US008200109B2

(12) United States Patent
Okada

(10) Patent No.: US 8,200,109 B2
(45) Date of Patent: Jun. 12, 2012

(54) IMAGE FORMING APPARATUS

(75) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 12/554,110

(22) Filed: Sep. 4, 2009

(65) Prior Publication Data

US 2010/0061750 A1 Mar. 11, 2010

(30) Foreign Application Priority Data

Sep. 8, 2008 (JP) ..... 2008-229547

(51) Int. Cl.
*G03G 15/06* (2006.01)

(52) U.S. Cl. ..... 399/55

(58) Field of Classification Search ..... 399/27, 399/55, 313, 314
See application file for complete search history.

(56) References Cited

U.S. PATENT DOCUMENTS

| | | | | |
|---|---|---|---|---|
| 5,179,397 | A | 1/1993 | Ohzeki et al. | 346/160 |
| 5,253,022 | A | 10/1993 | Takeuchi et al. | 355/274 |
| 5,331,383 | A * | 7/1994 | Nou et al. | 399/313 |

FOREIGN PATENT DOCUMENTS

| | | | |
|---|---|---|---|
| EP | 0391306 | A2 | 10/1990 |
| JP | 02-264278 | A | 10/1990 |
| JP | 2007-078896 | A | 3/2007 |

* cited by examiner

*Primary Examiner* — David Porta
*Assistant Examiner* — Faye Boosalis
(74) *Attorney, Agent, or Firm* — Fitzpatrick, Cella, Harper & Scinto

(57) ABSTRACT

An image forming apparatus includes a image bearing member (drum); a developing device for forming a developing portion at which an electrostatic latent image formed on the drum is developed with toner; a toner supply device for supplying toner to the developing device; a density detecting portion for detecting a density of a control toner image formed on the drum; a toner ratio detecting portion for detecting a toner ratio in a two component developer contained in the developing device; a transfer member for forming a transfer portion; a charging member for electrically charging the toner image formed by the developing device by being supplied with a bias of an identical polarity to a charge polarity of the toner; an adjusting portion for adjusting an amount of the toner supplied from the toner supply device so that the toner ratio is below a preset lower limit when the toner ratio detected by the toner ratio detecting portion reaches the lower limit; and a bias determining portion for determining, after the adjustment by the adjusting device, a condition of a bias to be applied to the charging member on the basis of a detection result of the density detecting portion with respect to the density of the control toner image formed on the drum.

19 Claims, 13 Drawing Sheets

IMAGE FORMING APPARATUS

FIELD OF THE INVENTION AND RELATED ART

The present invention relates to an image forming apparatus in which supply of toner to a developing device is controlled so that a density of a control toner image is a predetermined value. Specifically, the present invention relates to control for suppressing improper transfer when the control of the toner supply reaches its limit.

Such an image forming apparatus that a predetermined electrostatic latent image is formed on an image bearing member and is developed with toner to form a control toner image (color patch) and then a density of the control toner image is detected and toner supply to the developing device is controlled so that the density comes near to a predetermined value has been put into practical use. This is because the density of the toner image formed from the predetermined electrostatic latent image is derived into a predetermined value, so that a transfer efficiency of the toner image transferred onto a transfer medium (an intermediary transfer belt or a recording material) at a transfer portion can be kept at a high level (e.g., as shown in FIG. 7).

In order to keep the transfer efficiency at the high level, it is necessary to optimally adjust a relationship between a transfer set at the transfer portion and a charge amount of the toner image. For this purpose, a technique for adjusting the charge amount of the toner image at a level suitable for the transfer onto the transfer medium by providing a pretransfer charging device so as to irradiate the toner image as an image carried on the image bearing member with charged particles through corona discharge has been put into practical use. Further, a technique for adjusting a constant voltage to be applied to the transfer portion by detecting the charge amount of the toner in the developing device or the charge amount of the toner image carried on the image bearing member has also been put into practical use.

Japanese Laid-Open Patent Application (JP-A) 2007-78896 discloses an image forming apparatus in which toner supply to a developing device using a two component developer is controlled so that a density of a control toner image is a predetermined value, thereby to adjust the charge amount of the toner image at a level suitable for the transfer onto the transfer medium. In the image forming apparatus, a toner ratio (T/D ratio) in the two component developer electrically charged in the developing device is detected and after the T/D ratio reaches a lower limit, control is switched to that for adjusting a toner image forming condition so that the density of the control toner image is a predetermined value. This is because when the control toner image density is derived into the predetermined value also after the T/D ratio reaches the lower limit, the influence of insufficient toner in the two component developer is exerted on a resultant image.

That is, when the toner or a carrier is deteriorated by continuous formation of an image with a low image ratio, the charge amount of the toner is decreased, so that the density of the control toner image to be formed under a toner image forming condition (at a developing contrast Vcont) intended to provide a predetermined intermediate density tone gradation is increased. For this reason, by decreasing a toner supply amount to increase a friction opportunity between the toner and the carrier, the toner charge amount is restored and thus the control toner image density is derived into that for the predetermined intermediate density tone gradation. When the T/D ratio reaches a lower limit of 5%, in a state in which the T/D ratio is kept at 5%, a charging voltage, an exposure amount, a developing voltage, or the like is adjusted, so that the control toner image density is derived into that for the predetermined intermediate density tone gradation. This is because when the toner or the carrier is further deteriorated to further decrease the toner supply amount and the T/D ratio drops below 5%, development for a high density portion of an image is not performed properly to be liable to result in an insufficient density or density non-uniformity.

In the control described in JP-A 2007-78896, after the T/D ratio reaches the lower limit of 5%, it is difficult to optimally transfer the toner image formed of toner lowered in charge amount onto the intermediary transfer member or the recording material. This is because a transfer current set so as to be intended to provide the charge amount of the toner image in a normal range is excessive with respect to transfer charges necessary for the toner image lowered in charge amount an therefore the transfer efficiency is lowered (FIG. 7). For this reason, a fixed final image can cause a lowering in density and color unevenness.

SUMMARY OF THE INVENTION

A principal object of the present invention is to provide an image forming apparatus capable of alleviating a lowering in transfer efficiency irrespective of a toner ratio of a two component developer.

According to an aspect of the present invention, there is provided an image forming apparatus comprising:

a rotatable image bearing member;

a developing device for forming a developing portion at which an electrostatic latent image formed on the image bearing member is developed with toner;

a toner supply device for supplying toner to the developing device;

a density detecting portion for detecting a density of a control toner image formed on the image bearing member;

a toner ratio detecting portion for detecting a toner ratio in a two component developer contained in the developing device;

a transfer member for forming a transfer portion at which the toner image formed on the image bearing member is transferred onto a transfer material;

a charging member, disposed downstream of the developing portion and upstream of the transfer portion with respect to a rotational direction of the image bearing member, for electrically charging the toner image formed by the developing device by being supplied with a bias of an identical polarity to a charge polarity of the toner;

an adjusting portion for adjusting an amount of the toner supplied from the toner supply device so that the toner ratio is below a preset lower limit when the toner ratio detected by the toner ratio detecting portion reaches the lower limit; and a bias determining portion for determining, after the adjustment by the adjusting device, a condition of a bias to be applied to the charging member on the basis of a detection result of the density detecting portion with respect to the density of the control toner image formed on the image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
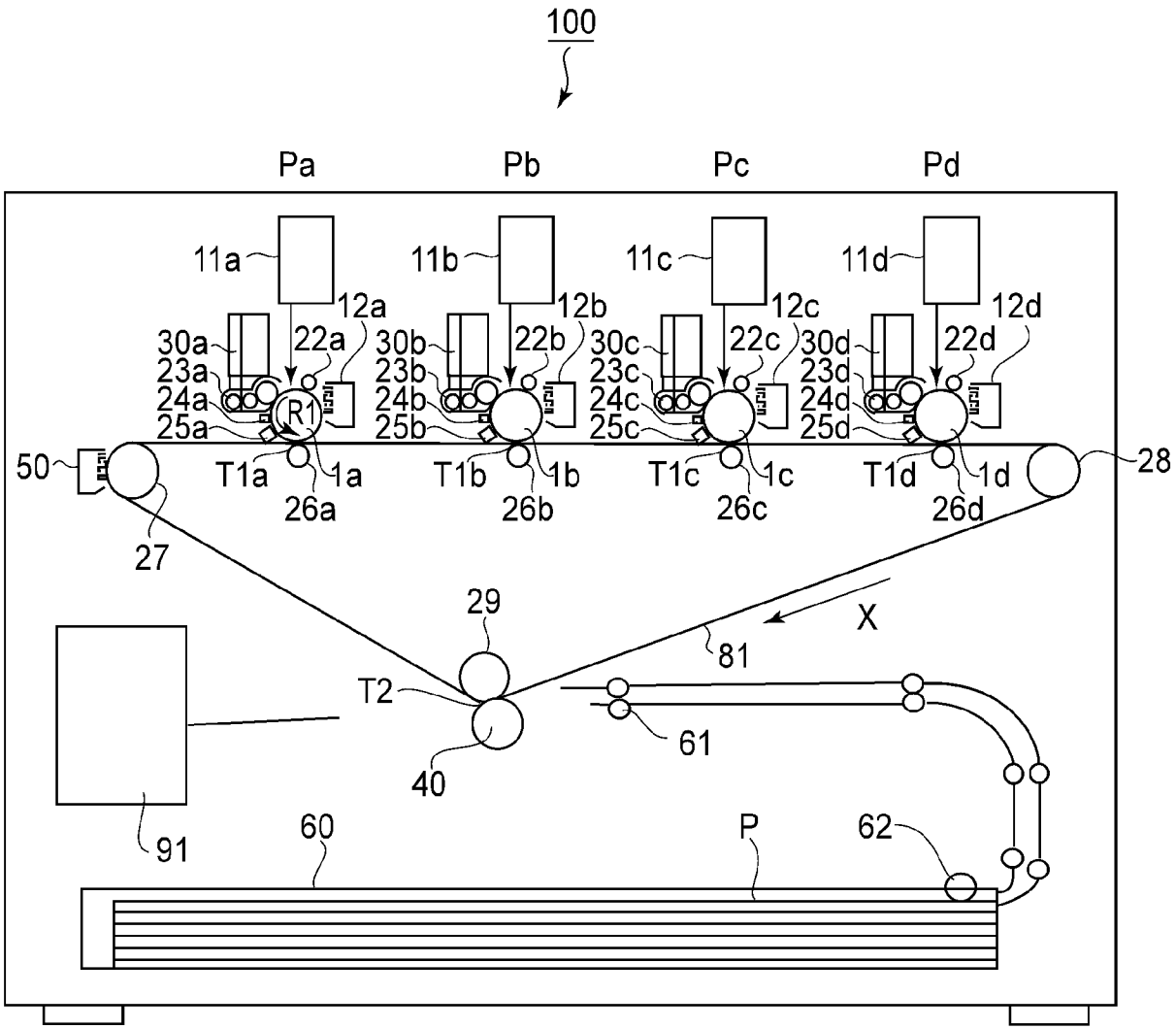
FIG. 1 is an explanatory view of a constitution of an image forming apparatus in First Embodiment.

Hereinbelow, several embodiments of the present invention will be described in detail with reference to the drawings. The present invention can also be carried out in other embodiments in which a part or all of constitutions of the embodiments are replaced with their alternative constitutions so long as after a T/D ratio reaches a lower limit, at least one of a toner image charge amount and a transfer current is different from a previous associated value.

In this embodiment, only a principal portion regarding formation/transfer of the toner image will be described but the present invention can be carried out in various image forming apparatuses such as a printer, various printing machines, a copying machine, a facsimile machine, and a multi-function machine by adding necessary equipment, device and casing structure. This embodiment is performed in a certain environment of a temperature of 30° C. and a relative humidity of 80% RH but a similar effect can also be achieved in other environments.

Incidentally, general constitution and control of the image forming apparatus described in JP-A 2007-78896 will be omitted from illustration and redundant explanation. Further, members or means represented by reference numerals or symbols are merely illustrative of the constitutions of the present invention but the constitutions of the present invention are not limited thereto.

First Embodiment

FIG. 1 is an explanatory view of a constitution of an image forming apparatus in First Embodiment.

As shown in FIG. 1, an image forming apparatus 100 is a digital-type electrophotographic image forming apparatus in which image forming stations Pa, Pb, Pc and Pd for yellow, magenta, cyan and black, respectively, provided along an intermediary transfer belt 81.

The intermediary transfer belt 81 is stretched around and supported by a driving roller 27, a tension roller 28, and an inner secondary transfer roller 29 and is driven by the driving roller 27 to move in a direction of an indicated arrow X at a process speed of 300 mm/sec. To the intermediary transfer belt 81, a stretching force of 30N is imparted by the tension roller 28.

The intermediary transfer belt 81 is adjusted to have a volume resistivity of $1\times10^{8}$ to $1\times10^{13}$ Ω×cm by adding carbon black in a dielectric resin material or the like as an antistatic agent in an appropriate amount. The dielectric resin material may be polycarbonate, polyethylene terephthalate resin film, polyvinylidene fluoride resin film, polyimide, ethylene-tetrafluoroethylene copolymer, or the like but may also be other materials adjusted to have different volume resistivities. In this embodiment, the intermediary transfer belt 81 is a 80 μm-thick endless seamless belt formed of an electroconductive polyimide material having a volume resistivity of $1\times10^{10}$ Ω×cm.

At the image forming station Pa, a yellow toner image is formed on a photosensitive drum 1*a* and is then primary-transferred onto the intermediary transfer belt 81. At the image forming station Pb, a magenta toner image is formed on a photosensitive drum 1*b* and is then primary-transferred onto the yellow toner image on the intermediary transfer belt 81 in a superposition manner. At the image forming stations Pc and Pd, a cyan toner image and a black toner image are formed on photosensitive drums 1*c* and 1*d* and are then successively primary-transferred onto the toner images on the intermediary transfer belt 81 in a similar superposition manner.

The four color toner images primary-transferred onto the intermediary transfer belt 81 are secondary-transferred collectively onto a recording material P supplied to a secondary transfer portion T2. The recording material P onto which the toner images are secondary-transferred is subjected to heating and pressing by a fixing device 91 to have the fixed toner images on its surface and then is discharged to the outside of the image forming apparatus.

The recording material P drawn from a recording material cassette 60 by a pick-up roller 62 is on standby at a position of a registration roller pair 61 and is sent to the secondary transfer portion T2 while being timed with the toner images on the intermediary transfer belt 81.

A belt cleaning device 50 removes untransferred toner deposited on the intermediary transfer belt 81 having passed through the secondary transfer portion T2 by rubbing the surface of the intermediary transfer belt 81 with a cleaning blade.

The image forming stations Pa, Pb, Pc and Pc include developing devices 23*a*, 23*b*, 23*c* and 23*d*, respectively, different in color of toners used, i.e., yellow, magenta, cyan and black, respectively. In toner supply chambers 30*a*, 30*b*, 30*c* and 30*d*, unused toners of yellow, magenta, cyan and black, respectively, are accommodated. However, the respective image forming stations are substantially similarly constituted without the above-described constitutions. In the following, the image forming station Pa will be described with reference to FIG. 2 and with respect to other image forming stations Pb, Pc and Pd, the suffix a of reference numerals (symbols) for representing constituent members (means) for the image forming station Pa is to be read as b, c and d, respectively, for explanation of associated ones of the constituent members.

<Electrostatic Latent Image Forming Means>

Figure 2:
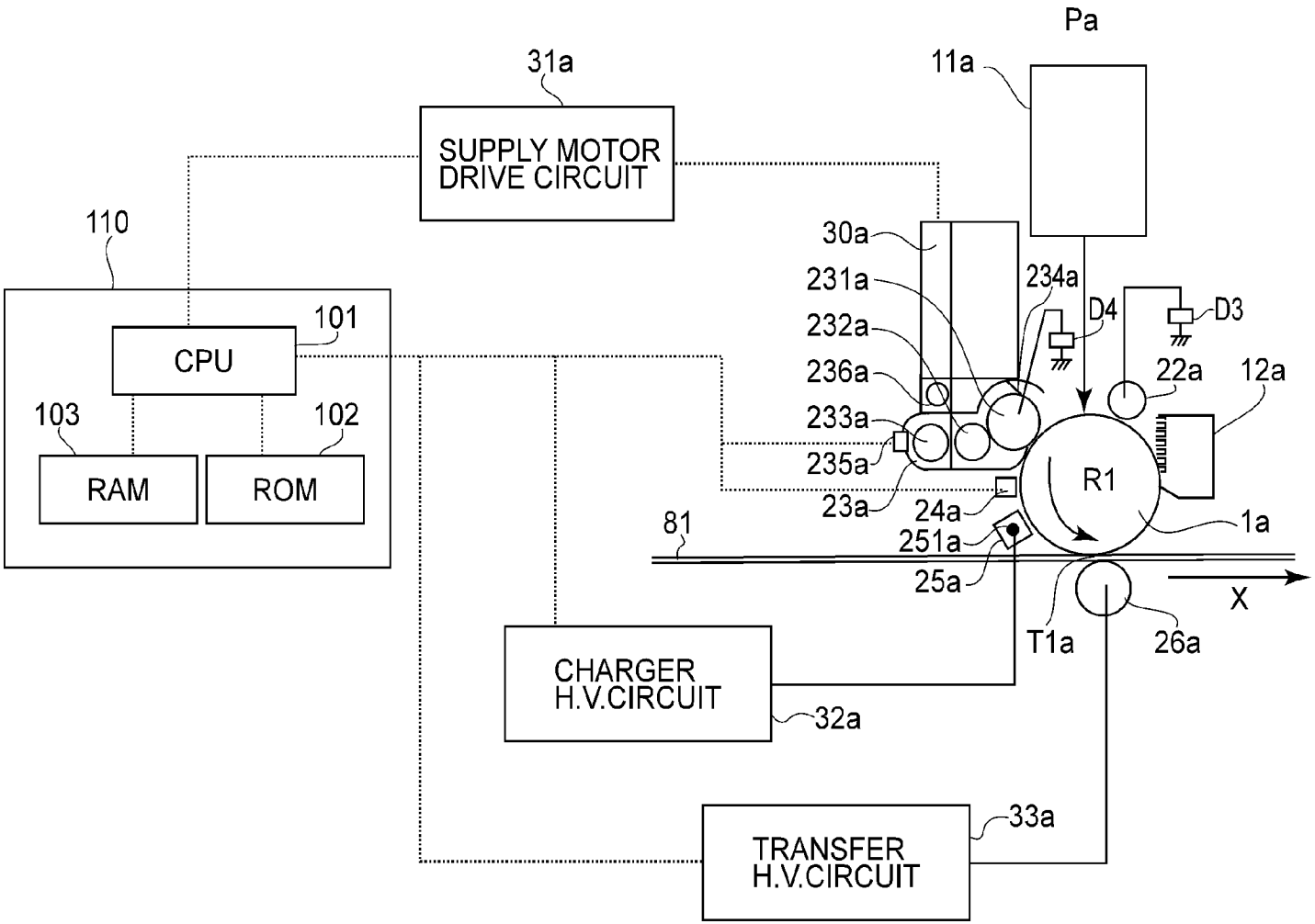
FIG. 2 is an explanatory view of a constitution of an image forming station.
Figure 3:
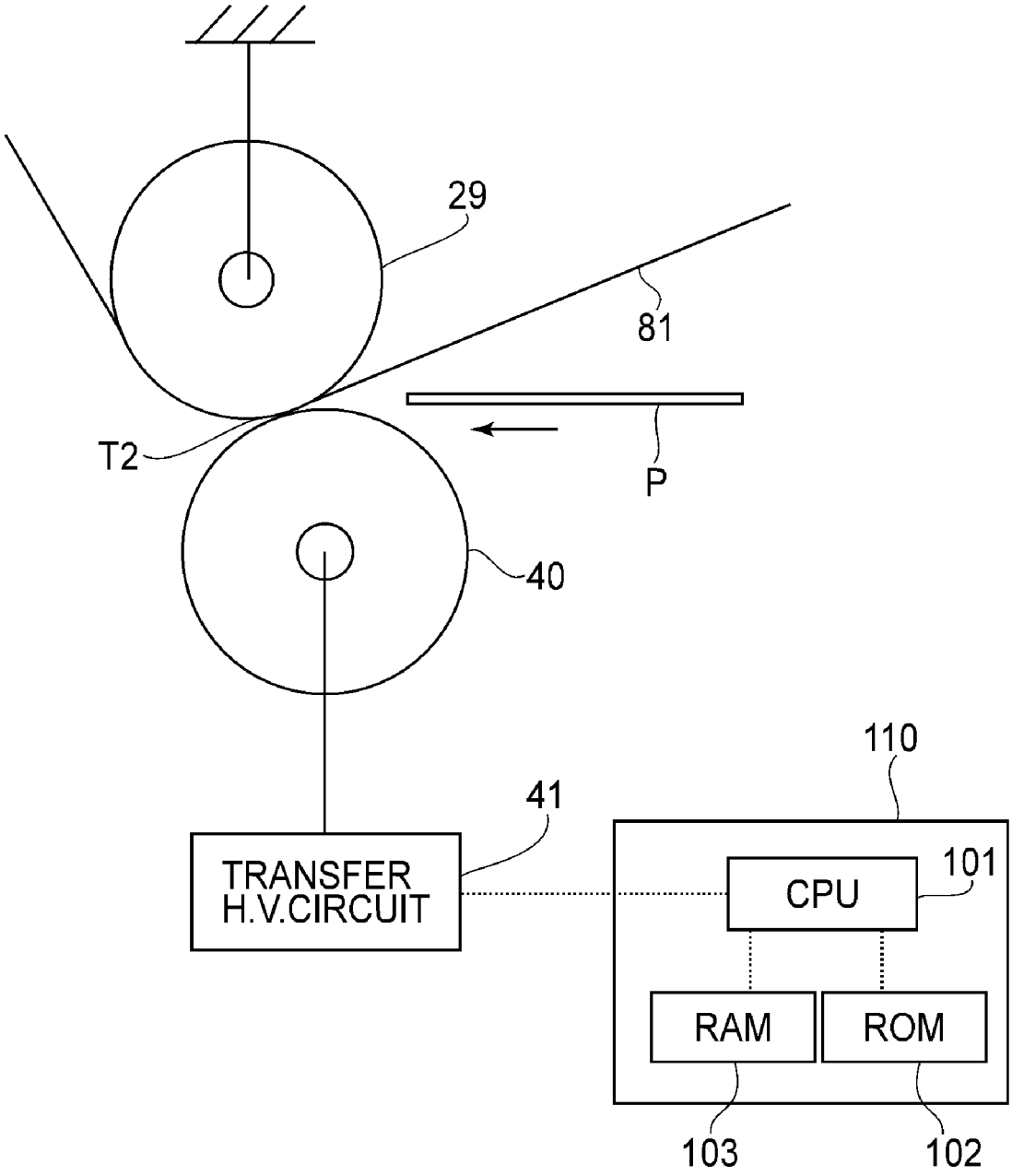
FIG. 3 is an explanatory view of a constitution of a secondary transfer portion.

FIG. 2 is an explanatory view of a constitution of the image forming station and FIG. 3 is an explanatory view of a constitution of the secondary transfer portion.

As shown in FIG. 2, the image forming station Pa includes the photosensitive drum 1*a* which is rotatably disposed drum-like electrophotographic photosensitive member. The photosensitive drum 1*a* is formed in a diameter of 84 mm and a length of 350 mm by forming an OPC (organic photoconductor) photosensitive layer on an outer peripheral surface of an aluminum-made cylinder. At the center of the photosensitive drum 1*a*, a shaft is provided and around which the photosensitive drum 1*a* is rotationally driven in a direction of an indicated arrow R1 at a process speed of 300 mm/sec by a driving mechanism (not shown). The photosensitive drum 1*a* may also be rotated at different speeds.

Around the photosensitive drum 1*a*, process devices such as a charging roller 22*a*, the developing device 23*a*, a patch detection sensor 24*a*, a pretransfer charging device 25*a*, a primary transfer roller 26*a*, and a cleaning device 12*a* are disposed.

The charging roller 22*a* is formed in a roller shape as a whole and is disposed in parallel to the photosensitive drum 1*a*. The charging roller 22*a* is rotated by the rotation of the photosensitive drum 1*a* in the arrow R1 direction. The charging roller 22*a* is constituted by disposing an electroconductive layer of a rubber material at an outer peripheral surface of a core metal of an electroconductive material disposed at the center thereof and is rotatably supported by shaft-supporting members (not shown) at both end portions of the core metal. The shaft-supporting member disposed at the both end portions are urged toward the photosensitive drum 1*a* by urging springs (not shown), so that the charging roller 22*a* is caused to press-contact the surface of the photosensitive drum 1*a* with a predetermined urging force.

A power source D3 applies a charging voltage in the form of a DC voltage biased with an AC voltage to the core metal of the charging roller 22*a*, so that the surface of the photosensitive drum 1 is electrically charged uniformly to a predetermined polarity and a predetermined potential by contact charging. In this embodiment, the charging voltage in the form of a DC voltage of 700 V biased with an AC voltage with a peak-to-peak voltage (Vpp) of 1500 V is applied although these values vary depending on a temperature, a humidity, and cumulative operation time of the photosensitive drum 1*a*.

An exposure device 11*a* scans the surface of the photosensitive drum 1*a* with a laser beam which has been subjected to ON-OFF modulation depending on an image signal expanded from image data, thus forming an electrostatic latent image for an image on the surface of the photosensitive drum 1*a*.

<Developing Means>

The developing device 23*a* develops the electrostatic latent image with a two component developer containing a magnetic carrier of a positive charge polarity and a non-magnetic toner of a negative charge polarity by using a two component developing system.

The inside of the developing device 23*a* is partitioned into a developing chamber in which a developing sleeve (developer carrying member) 231*a* and a feeding screw 232*a* are disposed and a stirring chamber in which a stirring screw 233*a* is disposed, by a partition wall. The partition wall is provided with a developer passage, on a front side and on a rear side thereof, for establishing communication between the developing chamber and the stirring chamber. The developing sleeve 231*a* rotates about a magnet fixed at the center thereof in a state in which the developing sleeve 231*a* carries the two component developer on its surface.

The feeding screw 232*a* and the stirring screw 233*a* are rotationally driven in interrelation with the developing sleeve 231*a* to feed the two component developer in mutually opposite directions along their shafts while stirring the two component developer, thus circulating the two component developer within the developing device 23*a*. During the circulation of the two component developer in the developing device 23*a*, the non-magnetic toner and the magnetic carrier are mutually triboelectrically charged to a negative polarity and a positive polarity, respectively.

The charged two component developer is fed from the feeding screw 232*a* to the developing sleeve 231*a* and is carried on the surface of the developing sleeve 231*a* in a state in which a chain of carrier particles is erected.

A layer thickness of the two component developer carried on the developing sleeve 231*a* is regulated by a regulating blade 234*a* and the two component developer is feed to a developing area opposing the photosensitive drum 1 with a spacing by the rotation of the developing sleeve 231*a*. Then, in the developing area, only the toner in the two component developer is electrostatically transferred onto the photosensitive drum 1, so that the electrostatic latent image is developed into a toner image.

A developing power source D4 applies a developing voltage comprising an oscillating voltage in the form of a predetermined DC voltage biased with an AC voltage to the developing sleeve 231*a* in order to improve a developing efficiency, i.e., a toner imparting ratio to be imparted to the electrostatic latent image. In this embodiment, the developing voltage in the form of a DC voltage of 520 V biased with an AC voltage having a peak-to-peak voltage (Vpp) of 1500 V.

The toner is consumed through the developing sleeve 231*a* and the two component developer lowered in toner content (T/D ratio) in the developing chamber is fed by the feeding screw 232*a* to be sent into the stirring chamber. The stirring screw 232*a* mixes and stirs the unused toner, fed from the toner supply chamber 30*a* by the rotation of a toner feeding screw 236*a*, and the two component developer which has already been present in the developing device 23*a* to enhance and uniformize the toner content (T/D ratio) in the two component developer.

The toner supply by the toner feeding screw 236*a* is controlled by controlling the rotation of the toner feeding screw 236*a* through a supply motor driving circuit 31*a*. In a ROM (read-only memory) 102 of a CPU (central processing unit) 101, control data and the like to be supplied to the supply motor driving circuit 31*a* is stored.

The patch detection sensor 24*a* emits infrared light from an infrared light-emitting element at an incident angle of 45 degrees in an axial direction plane of the photosensitive drum 1*a* so as to be incident on the photosensitive drum 1 and then detects specular reflected light from the photosensitive drum 1*a*. The patch detection sensor 24*a* outputs 8-bit binary data depending on reflected light intensity to the control portion 110.

The control portion 110 controls the exposure device 11*a* so as to write (form) the electrostatic latent image for the control toner image on the photosensitive drum 1*a* with a predetermined exposure amount (laser beam intensity) corresponding to that for a toner image with a predetermined density tone gradation and then controls the developing device 23*a* so as to develop the electrostatic latent image into the control toner image.

The control portion 110 detects the output of the patch detection sensor 24*a* to measure the density of the control toner image and then changes the toner content (T/D ratio) in the two component developer so that the density of the control toner image comes near to a predetermined density tone gradation level.

At a position in which the two component developer is delivered from the stirring screw 233*a* to the feeding screw 232*a*, an inductance sensor 235*a* is disposed to detect permeability of the two component developer with a restored toner content (T/D ratio).

The control portion 110 detects an output of the inductance sensor 235*a* to measure the toner content (T/D ratio: a ratio of a toner weight (T) to a total weight (D) of the magnetic carrier and the non-magnetic toner) in the two component developer.

<Pretransfer Charging Device>

The pretransfer charging device 25*a* is constituted by a corona charger in which a corona wire 251*a* is covered with a shield case, connected to the ground potential, at a periphery except for an opposing surface with respect to the photosensitive drum 1*a*.

A charger high voltage circuit 32*a* applies an auxiliary charging voltage in the form of a DC biased with an AC to the corona wire 251*a*. In this embodiment, the AC voltage has a constant peak-to-peak voltage (Vpp) of 7000 V, and the DC voltage (bias) is set to be variable by using constant-current control.

The pretransfer charging device 25*a* irradiates the toner image, as the image carried on the photosensitive drum 1, with negatively charged particles generated at the peripheral of the corona wire, so that the toner image charge amount is adjusted at a value suitable for transfer onto the intermediary transfer belt 81.

The control portion 110 changes the charge amount (toner charge amount) of the toner image carried on the photosensitive drum 1*a* depending on a magnitude of a set current value set for the charger high voltage circuit 32*a*.

<Transfer Power Source and Secondary Transfer Power Source>

The primary transfer roller 26*a* as a transfer member is formed in a diameter of 16 mm by covering an outer peripheral surface of an electroconductive roller shaft (core metal) having a diameter of 8 mm with a 4 mm-thick electroconductive elastic layer formed in a cylindrical shape. The elastic layer is adjusted to have a resistivity of $10^6$ to $10^8$ Ω×cm by mixing an ion conductive substance in a polymer elastomer or foamed polymer of rubber, urethane, etc. However, it is also possible to employ other materials and materials having other physical properties. The transfer member is used for transferring the toner image onto a transfer material such as the recording material carried on the intermediary transfer belt or a recording material conveying belt.

The primary transfer roller 26*a* includes both end shaft-supporting members, which are urged by spring members toward the photosensitive drum 1*a* with an urging force having a total pressure of 15N. As a result, the primary transfer roller 26*a* presses the intermediary transfer belt 81 against the photosensitive drum 1*a* to form a primary transfer portion T1*a* between the intermediary transfer belt 81*a* and the primary transfer roller 26*a*. The urging force for the primary transfer roller 26*a* may also be applied by other means.

A transfer high voltage circuit (transfer power source) 33*a* applies a positive DC voltage (bias) to the primary transfer roller 26*a*, so that the toner image conveyed to the primary transfer portion T1*a* by the rotation of the photosensitive drum 1*a* is primary-transferred onto the intermediary transfer belt 81. The transfer high voltage circuit (transfer power source) 33*a* effects constant-current control of a voltage to be applied to the primary transfer roller 26*a* so that a current flowing from the primary transfer roller 26*a* is a preset current value (25 μA) which is settable and changeable.

The cleaning device 12*a* removes untransferred toner which passed through the primary transfer portion T1*a* and has been deposited on the photosensitive drum 1*a* by rubbing the photosensitive drum 1*a* with the cleaning blade.

As shown in FIG. 3, a secondary transfer roller 40 is formed in an outer diameter of 24 mm by disposing an electroconductive elastic layer formed in a cylindrical shape on an outer peripheral surface of an electroconductive roller shaft (core metal) having a diameter of 12 mm. The elastic layer is adjusted to have a resistivity in a medium resistance range of $10^6$ to $10^8$ Ω×cm by mixing an ion conductive substance in a polymer elastomer or foamed polymer of rubber, urethane, etc. However, it is also possible to employ materials having other physical properties.

The inner secondary transfer roller 29 is an electroconductive roller formed of stainless steel, aluminum, or the like in a diameter of 21 mm and is connected to the ground potential.

A transfer high voltage circuit 41 as a secondary transfer power source applies a positive DC voltage to the core metal of the secondary transfer roller 40, so that the toner image carried on the intermediary transfer belt 81 is transferred onto the recording material P passing through the secondary transfer portion T2. However, it is also possible to employ a constitution in which the secondary transfer roller 40 is connected to the ground potential and a negative DC voltage is applied to the inner secondary transfer roller 29.

The applying method of the secondary transfer voltage is the constant-current control method similarly as in the case of the primary transfer voltage.

The transfer high voltage circuit (transfer power source) 41 effects constant-current control of a voltage to be applied to the secondary transfer roller 40 so that a current flowing from the secondary transfer roller 40 is a preset current value (45 μA) which is settable and changeable. The reason why a set value of the constant current at the secondary transfer portion T2 is larger than that at the primary transfer portion T1*a* is that secondary color toner images which provides more transfer charges and more transfer current required for the transfer than those for the single color toner image are collectively transferred onto the recording material P.

In this embodiment, the control of the applied transfer voltage was effected by the constant-current control settable with the transfer current value at both of the primary transfer portion T1*a* and the secondary transfer portion T2. However, it is also possible to employ a constant-voltage method and other methods so long as the method is capable of setting a transfer current correspondingly to the transfer charges of the toner image to be transferred. For example, the constant-voltage method using ATVC (active transfer voltage control) as described in JP-A Hei 2-264278 may also be employed.

In this embodiment, the cleaning blade of the cleaning device 12 and the belt cleaning device 50 is formed with the urethane rubber but may also be formed of other materials. The contact pressure between the photosensitive drum 1*a* and the intermediary transfer belt 81 is 10N but may also be appropriately changed.

<Toner Supply Means>

Figure 4:
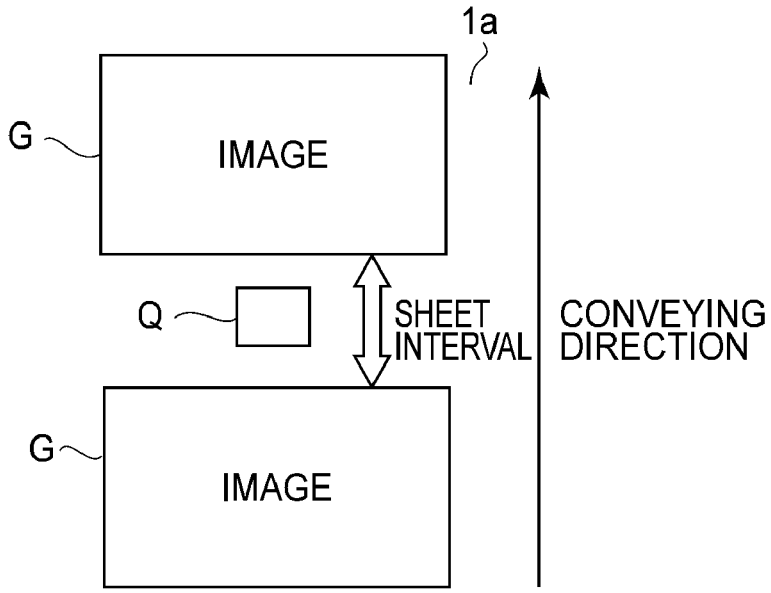
FIG. 4 is an explanatory view of a control toner image.
Figure 5:
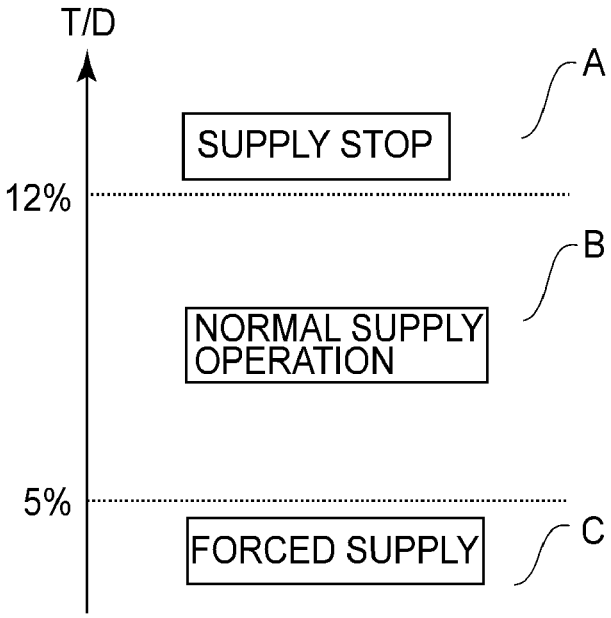
FIG. 5 is an explanatory view of a predetermined limit of a toner content in a two component developer.

FIG. 4 is an explanatory view of the control toner image and FIG. 5 is an explanatory view of a predetermined limit of the toner content in the two component developer.

As described with reference to FIG. 2, the toner content (T/D ratio) in the two component developer contained in the developing device 23*a* is lowered during development of the electrostatic latent image and therefore unused toner is supplied from the toner supply chamber 30 to the developing device 23*a*.

The control portion 110 effects patch detection ATR control such that the control toner image (color patch) is formed on the photosensitive drum 1*a* and the density of the control toner image is detected by the patch detection sensor 24*a* to control an amount of the toner supplied from the toner supply chamber 30.

The control portion 110 effects developer density detection ATR control such that the toner content (T/D ratio) in the two component developer is detected by the inductance sensor 235*a* to control the toner supply amount from the toner supply chamber 30.

As shown in FIG. 4 with reference to FIG. 2, in the patch detection. ATR control, during the continuous image formation, at an interval between adjacent toner images G on the photosensitive drum 1*a*, i.e., a so-called sheet interval as a non-image area, a control toner image (patch image) Q is formed.

An electrostatic latent image for the control toner image Q is referred to as a patch latent image. The patch latent image is developed into the control toner image by the developing device 23*a*. The density latent image is always formed under the same latent image condition, so that the control toner image developed therefrom has the same toner amount per unit area (the toner density) when the toner charge amount is the same.

Reflected light quantity of the control toner image Q carried on the photosensitive drum 1 is measured by the patch detection sensor 24*a*. The patch detection sensor 24*a* includes a light-emitting portion (not shown) provided with a light-emitting element such as an LED and a light-receiving portion (not shown) provided with a light-receiving element such as a photo-diode (PD) and outputs a numerical value depending on a light quantity (amount) of specular reflected light of infrared light emitted from the light-emitting portion so as to be incident on the photosensitive drum 1*a*. The patch detection sensor 24*a* measures the reflected light quantity of the control toner image with timing at which the control toner image on the photosensitive drum 1*a* passes below the patch detection sensor 24*a*.

The control portion 110 detects an output signal associated with a measurement result of the patch detection sensor 24*a* and calculates a patch density by using a density conversion table stored in a storing device 102 in advance, thus obtaining the toner supply amount capable of providing a desired patch density (reflected light quantity).

The sensor output signal treated as the patch density on the density conversion table is a value corresponding to the quantity (amount) of the specular reflected light from the control toner image, so that a smaller value provides a larger toner amount per unit area of the control toner image, thus resulting in a higher patch density. For example, in the case where the sensor output signal is 500 when the two component developer is in a fresh state and then is lowered to 400 when measured, this shows that the toner amount per unit area of the control toner image Q at the time of the measurement is increased compared with that in the fresh state, thus increasing the patch density.

The control portion 110 calculates the supply toner amount by forming the control toner image Q in the non-image area during normal image formation and then by detecting the patch density of the control toner image Q and then corrects an output image density as the need arises to keep the output image density at a constant level.

The control portion 110 also effects video count ATC control for controlling the toner supply amount predictively depending on an image ratio of the image intended to be formed. A total supply toner amount M by the video count CTR control and the patch detection ATR control is obtained from the following formula (1) as the sum of a basic supply amount Mv by the video count ATR control and a supply correction amount Mp by the patch detection ATR control.

$$M=Mv+Mp \tag{1}$$

The supply correction amount Mp is, as described above, obtained from a differential value ΔD between a reference value and an associate measurement result when the sensor output signal for the control toner image by the two component developer in the fresh state is taken as the reference value.

For example, when the sensor output signal for the control toner image Q by the two component developer in the fresh state is taken as Ds=500 and the patch density of the control toner image measured at the time of outputting an X-th sheet is taken as Dx=400, the differential value ΔD(x) is obtained from the following formula (2):

$$\Delta D(x)=Dx-Ds=100 \tag{2}$$

Further, a change amount ΔD1 of the sensor output signal for the control toner image Q when the toner content (T/D ratio) in the two component developer is deviated from the reference value by 1 is stored as a constant in the storing device (ROM) 102. The control portion 110 obtains the supply correction amount Mp from the following formula (3):

$$Mp=\Delta D(x)/\Delta D1 \tag{3}$$

The control portion 110 forms the electrostatic latent image of the photosensitive drum 1 in a digital manner. The basic supply amount Mv is obtained by a video count processing for counting an image dot of an image signal output from the exposure device 11*a*. The video count value is converted into the basic supply amount Mv by using a table, stored in the storing device 102 in advance, showing a relationship between the video count value and the supply toner amount. Thus, the basic supply amount Mv for each image is calculated every image formation.

The control portion 110 adds the supply correction amount Mp on the basis of the detection result of the patch detection sensor 24*a* to the basic supply amount Mv on the basis of the digital image signal for each pixel of the electrostatic latent image formed on the photosensitive drum 1*a*, thus controlling the toner supply operation.

<Toner Ratio Detecting Means>

As shown in FIG. 2, the control portion 110 effects the developer density detection ATR control to judge as to whether or not a current toner content (T/D ratio) in the two component developer is in a supply control limit area in which limitation of the toner supply control is made.

The inductance sensor 235*a* is disposed in the neighborhood of the feeding screw 232*a* in the developing device 23*a*. The inductance sensor 235*a* detects the permeability of the two component developer in a certain volume, so that the two component developer stably circulates and flows and is disposed in the neighborhood of a stirring portion at which a fluctuation in certain volume is small.

Based on the detection result of the permeability by the inductance sensor 235*a*, the toner content (T/D ratio) in the two component developer contained in the developing device 23*a* is obtained by making reference to the T/D conversion table stored in the storing device 102 in advance and is held in a computing (operational) memory (RAM) 103. The toner density may also be measured by detecting the reflected light quantity (amount) in the two component developer.

<Control Means>

As shown in FIG. 5, the control portion 110 effects the toner supply control based on the toner content (T/D ratio) in the two component developer, the basic supply amount Mv, and the supply correction amount Mp.

In an area A in which the toner content (T/D ratio) exceeds 12%, even when it is judged that the patch density of the control toner image as the result of the patch detection ATR control is low, there is an increasing possibility of an overflow of the two component developer and an occurrence of fog when the toner content (T/D ratio) is increased further. For that reason, the control portion 110 regulates the toner supply to stop the supply so that the toner content (T/D ratio) is 12% or less.

In an area C in which the toner content (T/D ratio) is 5% or less, even when it is judged that the patch density of the control toner image as a result of the patch detection ATC control is high, there is an increasing possibility of a lowering in developing property of the developing sleeve 231*a*. For that reason, the control portion 110 regulates the toner supply to effect forced supply so that the toner content (T/D ratio) does not lower below 5%.

As described above, the control portion 110 puts a predetermined limit on the toner supply control and stops the toner supply control by the patch detection ATR control in the case where the detection result of the toner content (T/D ratio) is above a predetermined upper limit of 12% and is below a predetermined lower limit of 5%. That is, outside an area B in which a normal supply operation is performed by the patch detection ATR control, correction control limit areas (A and C) in which the patch density of the control toner image Q is not fed back to the toner supply control are provided.

In other words, the toner content (T/D ratio) in the two component developer is very important factor for stabilizing an image quality. However, a charge amount Q/M of the toner image varies depending on degradation of the magnetic carrier in the two component developer or an environmental fluctuation, so that a developing property is changed. For this reason, even when the toner content (T/D ratio) in the two component developer can be kept at a constant level, the image density is changed in the case where the magnetic carrier degradation or the environmental fluctuation is caused to occur.

In the patch detection ATR control, the patch density of the control toner image on the photosensitive drum is kept at the constant level, so that the toner supply state is continued when the low patch density due to the lowering in developing property caused by the increase in toner charge amount Q/M is detected. For that reason, the toner is filled in the developing device, so that the overflow of the developer or the fog can occur.

On the other hand, when the high patch density due to the increase in developing property caused by the lowering in toner charge amount Q/M is detected, the toner supply stop state is continued. For that reason, due to a decrease in toner amount in the developing device, a toner coating amount onto the developing sleeve is decreased (improper coating), so that image deterioration can be caused to occur.

The above-described overflow of the developer, the fog, and the improper toner coating results in image defect and there is a possibility that a performance of the main assembly of the image forming apparatus is impaired at worst.

EMBODIMENT 1

Figure 6:
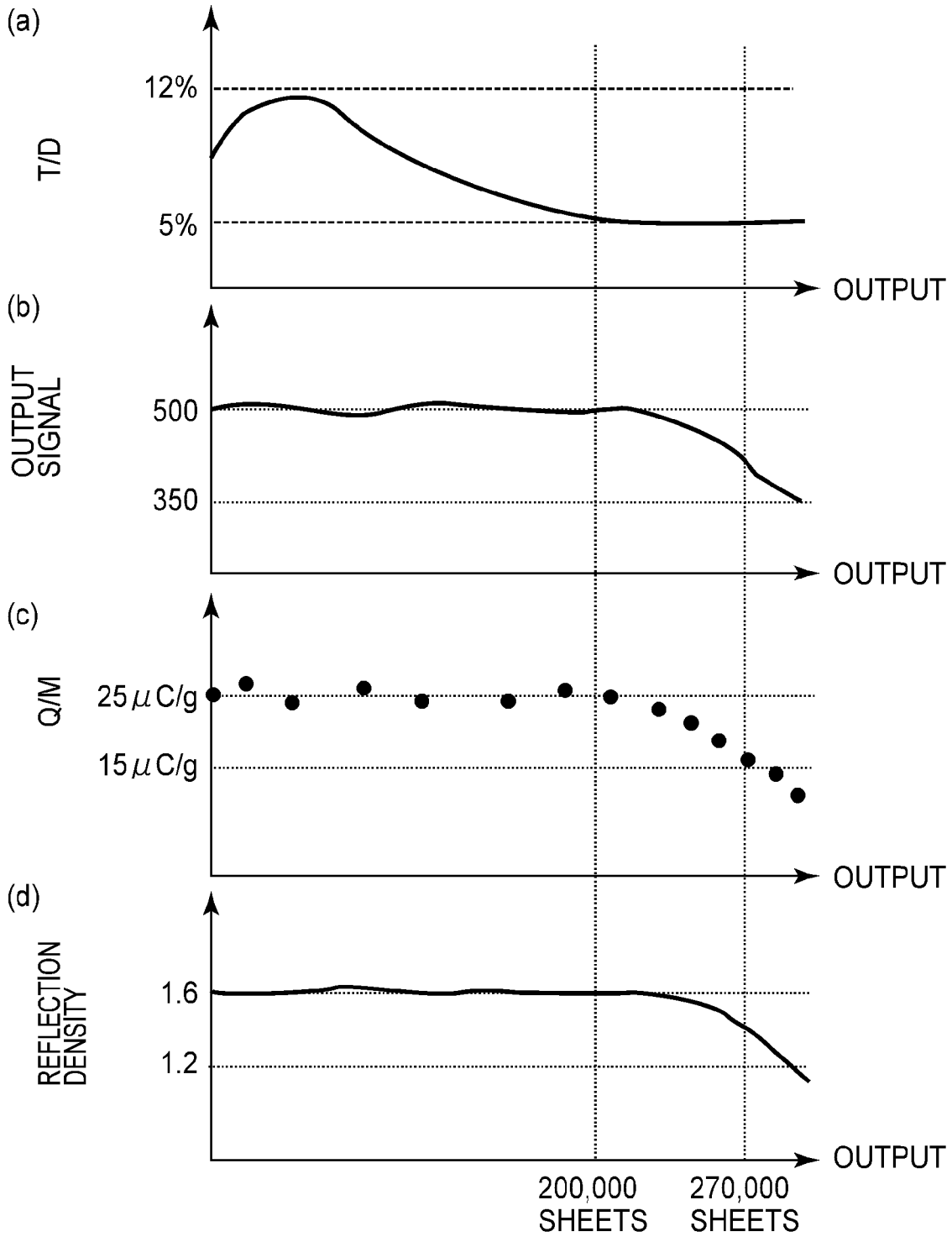
FIG. 6 is a time chart of control in Embodiment 1.
Figure 7:
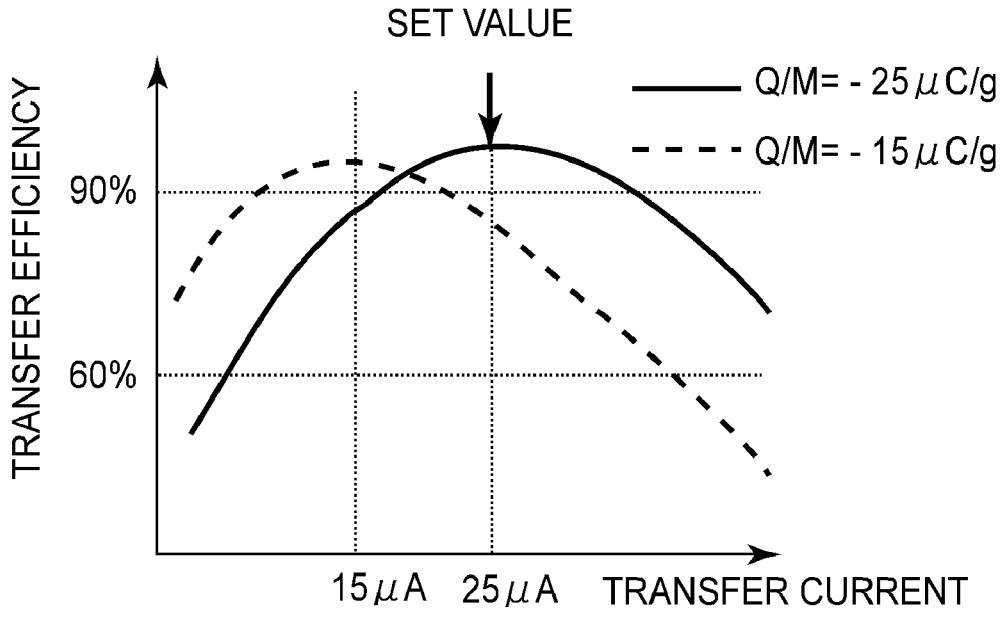
FIG. 7 is an explanatory view of a proper transfer current depending on a charge amount of a toner image.
Figure 8:
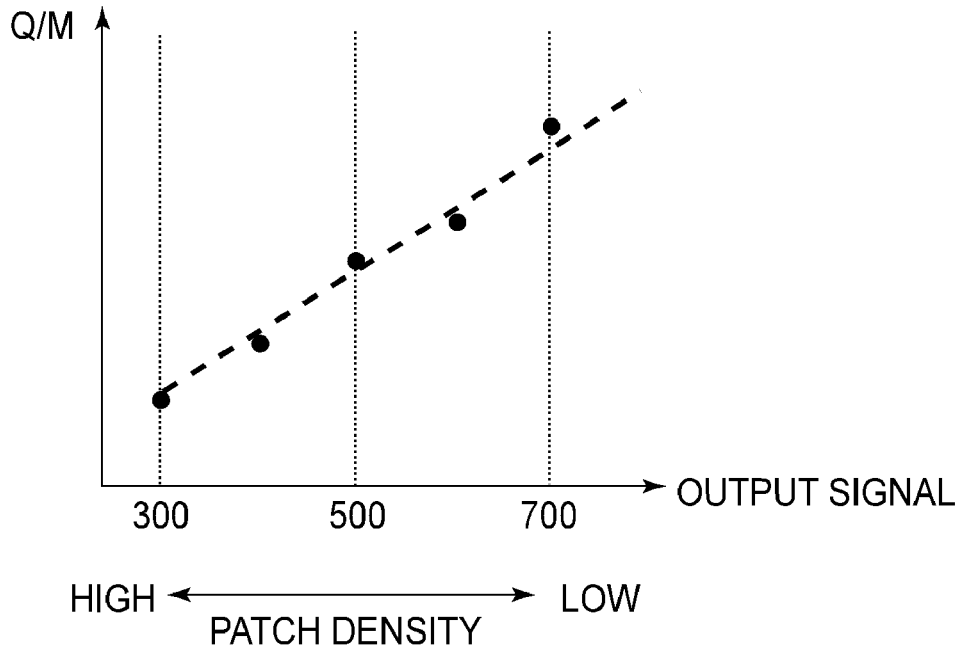
FIG. 8 is an explanatory view of a relationship between a patch density and the charge amount of the toner image.
Figure 9:
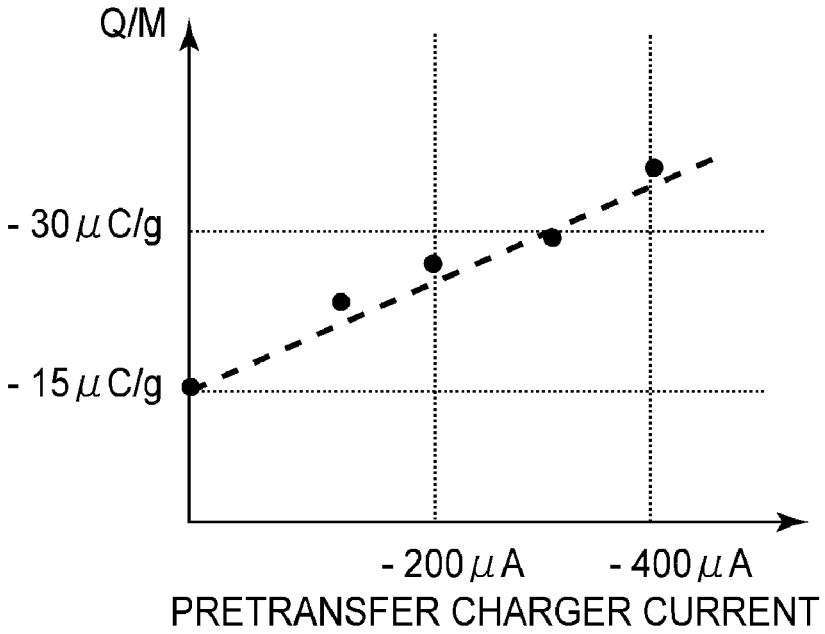
FIG. 9 is an explanatory view of a relationship between current setting of a pretransfer charging device and the charge amount of the toner image.
Figure 10:
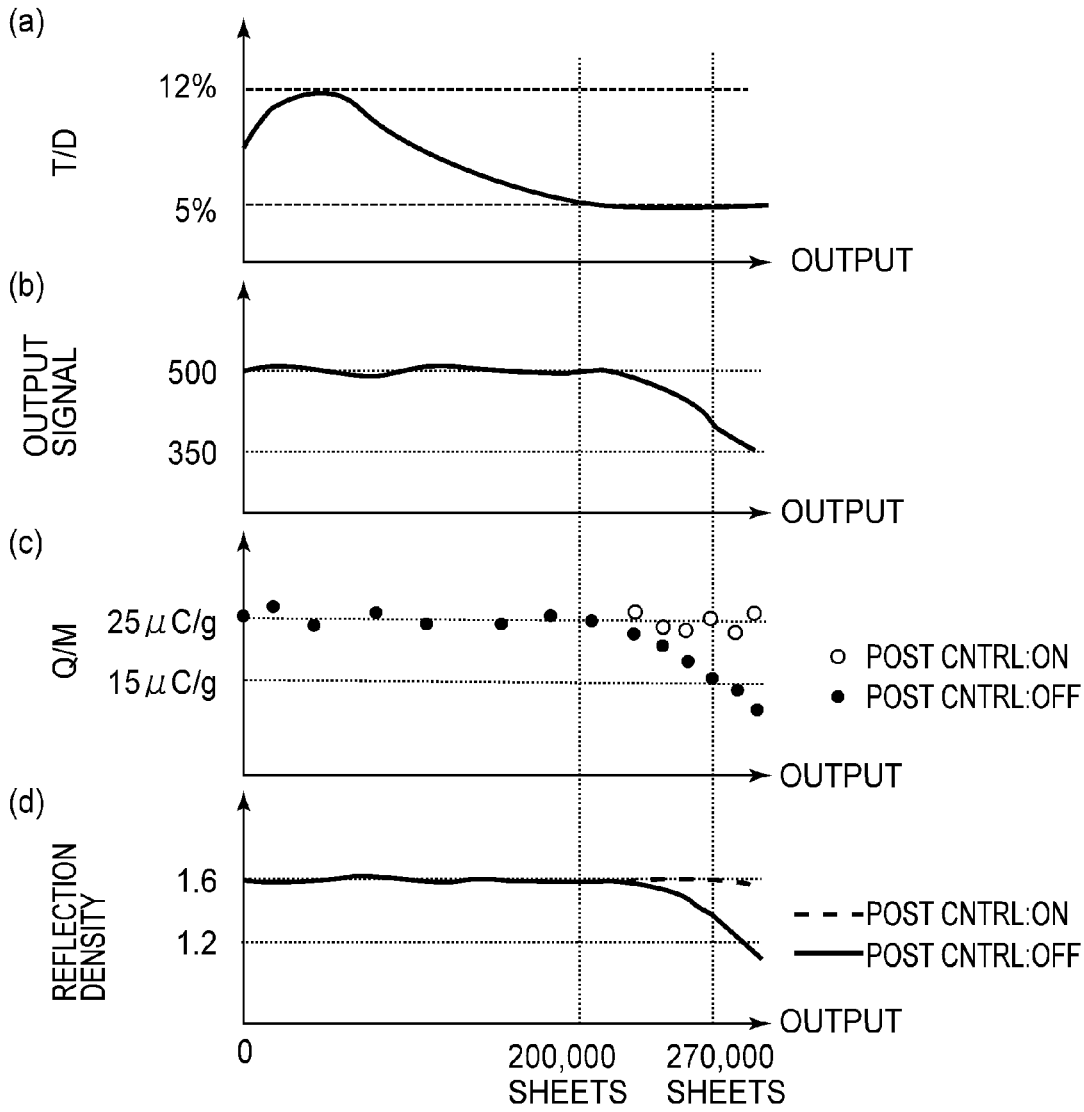
FIG. 10 is an explanatory view of an effect of the control in Embodiment 1.
Figure 11:
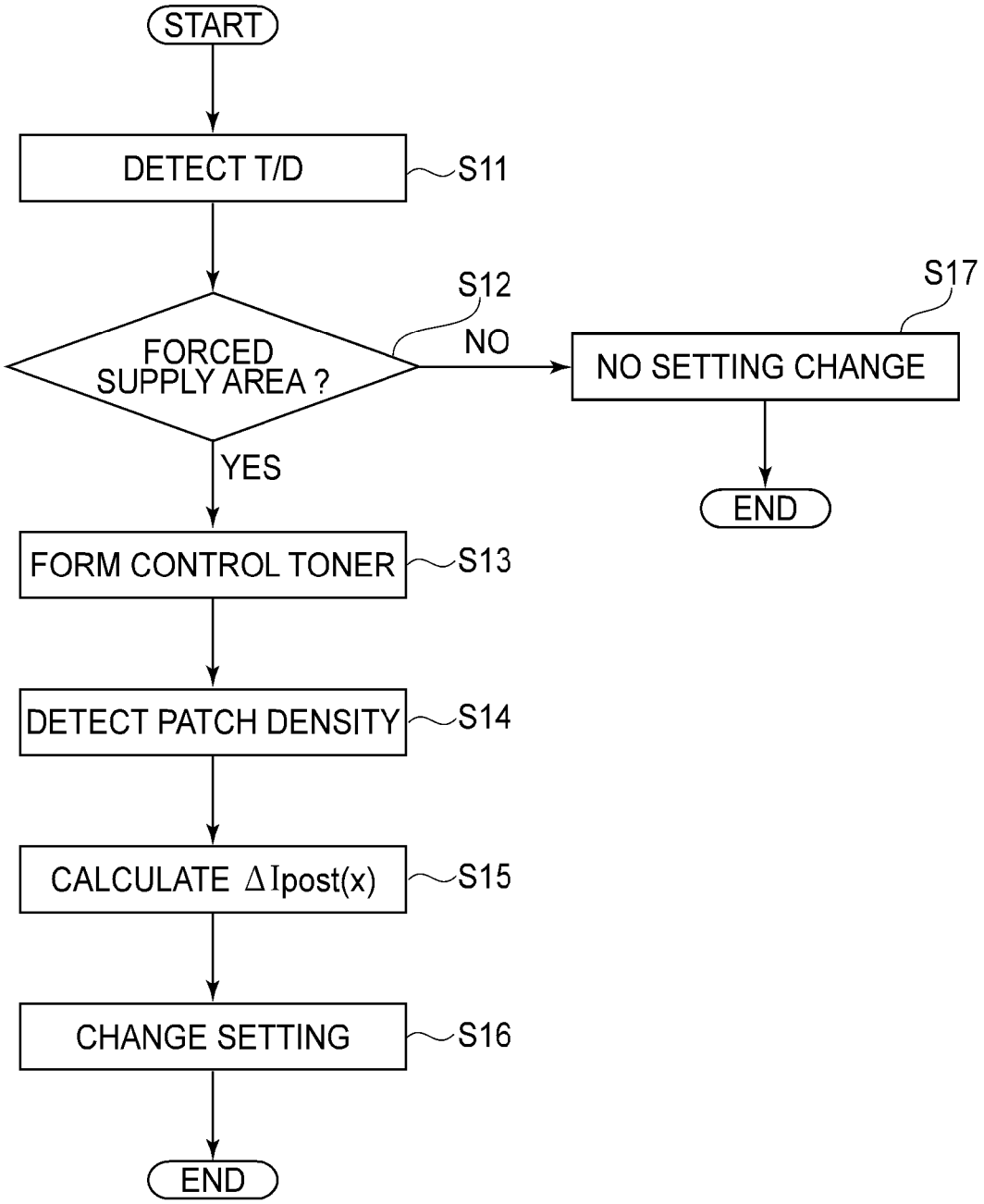
FIG. 11 is a flow chart of the control in Embodiment 1.

FIG. 6 is a time chart of control in Embodiment 1, FIG. 7 is an explanatory view of a proper transfer current depending on a charge amount of the toner image, FIG. 8 is an explanatory view of a relationship between a patch density and the toner image charge amount, and FIG. 9 is an explanatory view of a relationship between current setting for the pretransfer charging device and the toner image charge amount. FIG. 10 is an explanatory view of an effect of control in Embodiment 1 and FIG. 11 is a flow chart of the control in Embodiment 1.

When the toner supply control as described above is effected, in the correction control limit area, it is difficult to stabilize the image density. When the toner content (T/D ratio) in the two component developer reaches the predetermined limit, the detection result of the patch density of the control toner image is reflected in a developing condition (developing contrast), so that the image density is kept at a constant level.

However, in this case, there is an increasing possibility that the image defect or a deterioration in transfer property is caused to occur in a process of primary-transferring the toner image from the photosensitive drum 1*a* onto the intermediary transfer belt 81 or in a process of secondary-transferring the toner image from the intermediary transfer belt 81 onto the recording material P. This is because even when the developing contrast is changed, the toner image charge amount after the development is not changed and therefore a relationship between the toner image charge amount and the transfer current becomes improper.

In the case where the toner image charge amount (a charge amount of toner per unit weight) Q/M is lowered, a transfer electric field is excessively applied and an excessive current flows, to that a charge polarity of the toner is inverted and therefore there is an increasing possibility of an occurrence of the image defect or the lowering in density.

Further, when the toner image charge amount Q/M is lowered, an electrostatic depositing force of the toner on the photosensitive drum 1*a* or the intermediary transfer belt 81, so that the toner is liable to scatter from the rotating photosensitive drum 1*a* or the rotating intermediary transfer belt 81.

In Embodiment 1, the control portion 110 operates the pretransfer charging device 25*a* in the case where the toner content (T/D ratio) is judged as being in the correction control limit area, (the area C in FIG. 5) in which the toner content is 5% or less, on the basis of the detection result of the inductance sensor 235*a*. The toner image obtained by the development is negatively charged by the pretransfer charging device 25*a* to restore the lowered toner image charge amount Q/M to a state such that the restored charge amount Q/M is suitable for a voltage-current condition at the primary transfer portion T1*a* and the secondary transfer portion T2. The transfer electric field adapted for the toner image charge amount Q/M is applied to the toner image with the corrected charge amount, so that a proper transfer current passes through the toner image and thus the image defect and the density lowering are prevented.

As shown in FIG. 6 with reference to FIG. 2, continuous output was performed by using the recording material of A4-sized plain paper. FIG. 6(*a*) shown a change in toner content obtained from an output of the inductance sensor 235*a* and FIG. 6(*b*) shows a change in sensor output signal of the patch detection sensor 24*a*. FIG. 6(*c*) shows a change in toner image charge amount Q/M and FIG. 6(*d*) shows a change in reflection density of a final image transferred and fixed on the recording material P. The charge amount Q/M was obtained by sucking the toner image on the photosensitive drum 1*a* on a downstream side of the pretransfer charging device 25*a* and then by measuring each of an electric charge amount Q of the sucked toner image and a toner weight M. For measurement of the reflection density, a reflection densitometer (mfd. by X-Rite Inc.) was used and a density of the toner on the photosensitive drum 1*a* was kept at a constant level of 0.6 mg/cm$^2$. This is because the influence of the lowering in transfer efficiency through the primary transfer and the secondary transfer is measured by keeping the toner density on the photosensitive drum 1*a* at the constant level. Further, this is because an amount of the lowering in image density of the final image caused by the lowering in transfer efficiency due to the lowering in toner image charge amount Q/M when the density of the control toner image carried on the photosensitive drum 1*a* is kept at the constant level by adjustment of the developing contrast.

As shown in FIG. 6(*a*), a detection result of the toner content (T/D ratio) is kept at 5% as the lower limit in the correction control limit area after the output sheet number exceeds 200,000 sheets. The toner supply means supplies toner to the developing device so that the toner content is not below 5%.

As shown in FIG. 6(*b*), after the output sheet number exceeds 200,000 sheets, the sensor output signal of the patch detection sensor 24*a* is decreased from about 500.

This shows, as shown in FIG. 6(*c*), that the toner charge amount Q/M is lowered and the patch density of the control toner image formed with a predetermined developing contrast is increased to increase the quantity (amount) of the reflected light scattered by the control toner image, so that the sensor output signal is lowered.

After the output sheet number exceeds 200,000 sheets, the toner content is in the correction control limit area and thus the toner is subjected to forced supply control, so that the toner charge amount Q/M is further lowered. However, by changing the developing contrast, at least the toner density of the toner image formed on the photosensitive drum 1*a* is kept at the constant level.

As shown in FIG. 6(*d*), however, when the toner image charge amount Q/M is lowered, the transfer efficiencies at the primary transfer portion T1*a* and the secondary transfer portion T2 are lowered, so that the reflection density of the final image transferred and fixed on the recording material P is lowered.

As shown in FIG. 7 with reference to FIG. 2, a proper transfer current at the primary transfer portion T1*a* is different between when the toner image charge amount Q/M on the photosensitive drum 1*a* is −25 μC/g (solid line) and when the charge amount Q/M is −15 μC/g (broken line). FIG. 7 shows a transfer current dependency of the primary transfer efficiency when the toner density on the photosensitive drum 1*a* is 0.6 mg/cm$^2$.

By the lowering in charge amount Q/M, the curve of the transfer efficiency is shifted toward a low current side, so that the transfer electric field is excessively applied at an original set value to cause excessive transfer current flow, thus lowering the transfer efficiency. A similar phenomenon also occurs at the secondary transfer portion T2. Thus, the lowering in transfer efficiency at the primary transfer portion and that at the secondary transfer portion are added up, so that the lowering in reflection density of the final image.

Further, after the output sheet number exceeds 270,000 sheets, in addition to a decrease in electrostatic depositing force of the toner on the photosensitive drum 1*a* and the intermediary transfer belt 81, the excessive transfer electric field is applied, so that the toner scattering is increased to considerably worsen image graininess. When the charge amount Q/M is lowered, which an image deterioration becomes serious.

In this embodiment, a relationship between the patch density (sensor output signal) and the charge amount Q/M of the control toner image detected by the patch detection sensor 24*a* and a relationship between a set current value for the pretransfer charging device 25*a* and the charge amount Q/M are stored in the storing device 102 in advance.

The control portion 110 obtains an optimum set current value for the pretransfer charging device 25*a* in order to correct the lowered charge amount Q/M and use the optimum set current value during the image formation. The patch density is obtained by detecting the control toner image formed under a predetermined toner image forming condition (developing contrast) by using the patch detection sensor 24*a*. Then, a control amount (set current value) for the pretransfer charging device 25*a* necessary to correct the control toner image charge amount Q/M, changed from a normal value, to the normal value is obtained from the detection result of the patch density. As a result, without directly measuring the charge amount Q/M of the control toner image, it is possible to device the charge amount Q/M to the normal value through accurate estimation.

As shown in FIG. 8, there is a tendency that the sensor output signal is lowered to decrease the charge amount Q/M when the patch density of the control toner image formed under a certain toner image forming condition (developing contrast), so that the sensor output signal and the charge amount Q/M establish a linear relationship. Therefore, a slope A of the rectilinear line is stored in the storing device 102 in advance. Further, a charge ΔQ/M(x) of the charge amount Q/M is obtained from a differential value ΔD(x) between a sensor output signal (reference value) of the control toner image formed with the two component developer in the fresh state and a sensor output signal (current value) at the time of outputting a cumulative amount of x sheets by using the slope A according to the following formula (4):

$$\Delta Q/M(x)=A\times(-\Delta D(x)) \tag{4}$$

The reason why (−ΔD(x)) is used in the formula (4) is that ΔD(x) is a differential value with respect to the initial value and thus needs inversion of a vector direction.

As shown in FIG. 9, a charging performance is enhanced when the set current value for the pretransfer charging device 25*a* is increased, so that the charge amount Q/M is also increased. Thus, a relationship between the set current value and the charge amount Q/M shows linearity. Therefore, a slope B of the rectilinear line is stored in the storing device 102 in advance and then a change value ΔIpost of the set current value for the pretransfer charging device 25*a* for cancelling the change ΔQ/M(x) of the toner image charge amount Q/M until the output sheet number reaches the x sheets is obtained. A relationship between the charge ΔQ/M of the charge amount Q/M and the change value ΔIpost(x) of the set current value is obtained from the following formula (5):

$$\Delta Q/M(x)=B\times\Delta I\mathrm{post}(x) \tag{5}$$

According to the formulas (4) and (5), the change value ΔIpost(x) of the set current value for the pretransfer charging device 25*a* is obtained from the differential value ΔD(x) between the reference value of the sensor output signal and the sensor output signal at the time of outputting the output sheet number of x sheets in accordance with the following formula (6):

$$\Delta I\mathrm{post}(x)=(A/B)\times(-\Delta D(x)) \tag{6}$$

ΔIpost(x) obtained from the formula (6) is held in the computing memory 103 and, during subsequent image formation, is set for the pretransfer charging device 25*a* by the control portion 110 through the charger high voltage circuit 32*a*. As a result, the lowered charge amount Q/M of the toner image is corrected to the normal value. That is, without directly measure the toner image charge amount, by estimating the toner image charge amount Q/M from the measurement result of the patch density value, it is possible to set a proper control amount for the pretransfer charging device 25*a*.

A result of an experiment in which control for changing the set current value for the pretransfer charging device 25*a* after the toner content (T/D ratio) is kept at 5% is effected by using the relationship of the formula (6) is shown in FIGS. 10(*a*) to 10(*d*). The measuring method and the like in FIGS. 10(*a*) to 10(*d*) are the same as those in FIGS. 6(*a*) to 6(*d*) described above.

As shown in FIG. 10(*c*), in the change of the toner image charge amount Q/M, a black dot represents the case where the pretransfer charging device 25*a* is not used and a white circle represents the case where the pretransfer charging device 25*a* is actuated with the set current value in accordance with the formula (6). By the control for changing the set current value for the pretransfer charging device 25*a* in this embodiment, the lowered charge amount Q/M of the toner image can be corrected to the initial value.

As shown in FIG. 10(*d*), in the change in reflection density of the final image, a solid line represents the case where the pretransfer charging device 25*a* is not used and a broken line represents the case where the pretransfer charging device 25*a* is actuated with the set current value in accordance with the formula (6). By the control for changing the set current value for the pretransfer charging device 25*a* in this embodiment, the lowering in reflection density of the output image occurring when the charge amount Q/M is lowered does not occur, so that a good density change can be retained.

Further, the scattering image occurring in the case where the pretransfer charging device 25*a* is not used is also improved, so that the deterioration of image quality is also prevented.

As shown in FIG. 11 with reference to FIG. 2, the control portion 110 obtains the toner content (T/D ratio) from the output of the inductance sensor 235*a* (S11).

When the toner content (T/D ratio) is in the normal supply operation area of 5% to 12% (NO of S12), the control portion 110 does not change the set current value for the pretransfer charging device 25*a* (S17). However, when the toner content (T/D ratio) is in the forced supply area or supply stop area (correction control limit area) of 5% or less or 12% or less (YES of S12), the control toner image is formed with the predetermined developing contrast (S13) and the patch density is measured (S14).

The control portion 110 calculates the change value ΔIpost (x) of the set current value according to the formula (6) by using the measurement result of the patch density (S15) and sets the calculated change value ΔIpost(x) for the pretransfer charging device 25*a* (S16).

According to the control in Embodiment 1, in the correction control limit area in which the toner supply limitation is made, the pretransfer charging device is controlled on the basis of the detection result of the patch detection ATR control. As a result, the lowering in charge amount Q/M of the toner image on the photosensitive drum 1*a* is supplemented, so that the image density and the image quality are stabilized.

EMBODIMENT 2

Figure 12:
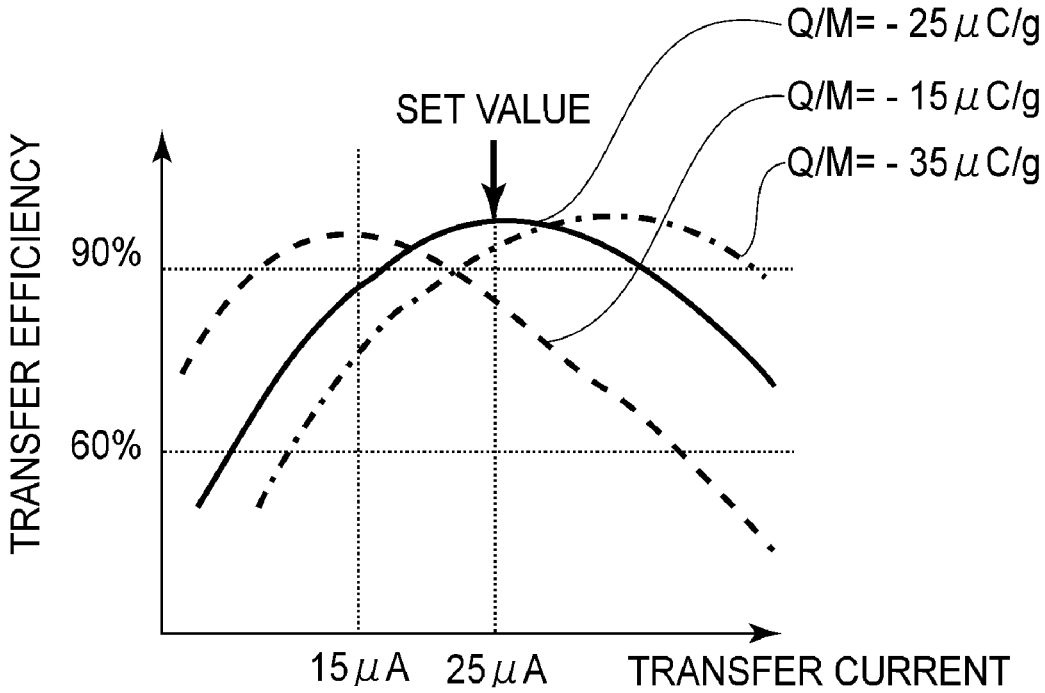
FIG. 12 is an explanatory view of a relationship between a transfer current and a transfer efficiency.
Figure 13:
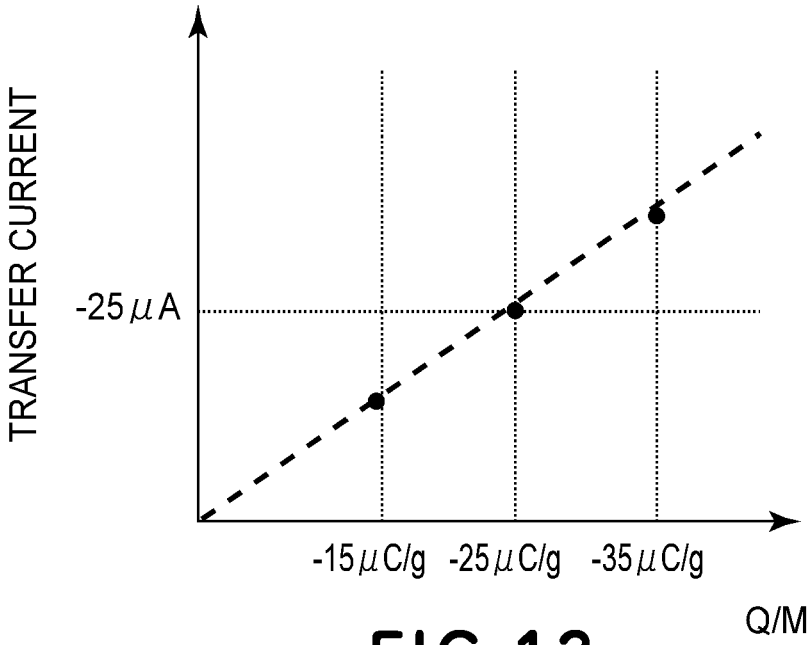
FIG. 13 is an explanatory view of a relationship between the toner image charge amount and a transfer current value providing a maximum transfer efficiency at a primary transfer portion.
Figure 14:
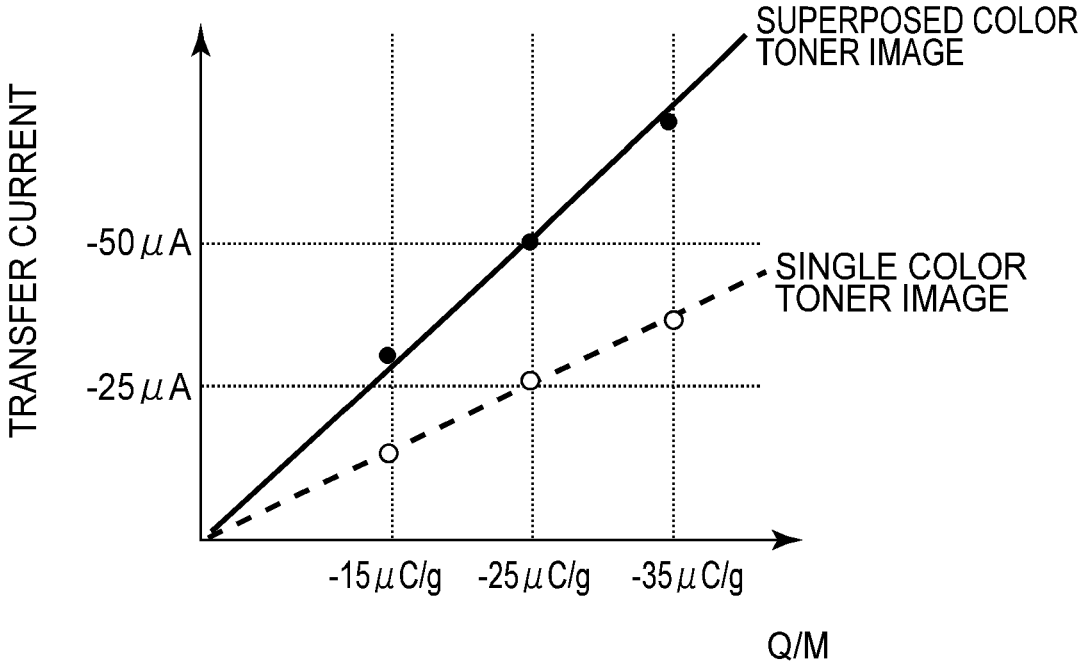
FIG. 14 is an explanatory view of a relationship between the toner image charge amount and a transfer current value providing a maximum transfer efficiency at a secondary transfer portion.
Figure 15:
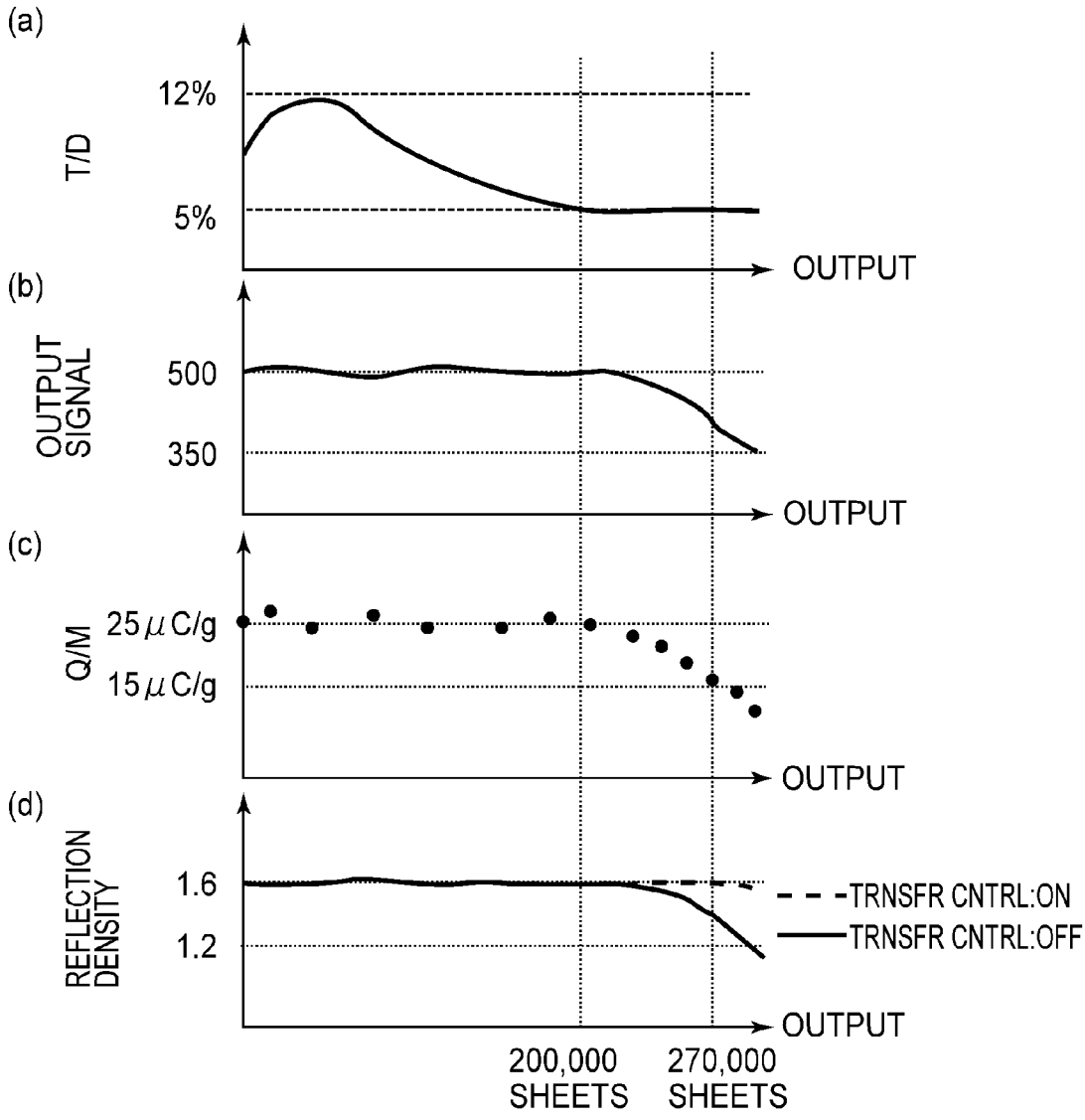
FIG. 15 is an explanatory view of an effect of control in Embodiment 2.
Figure 16:
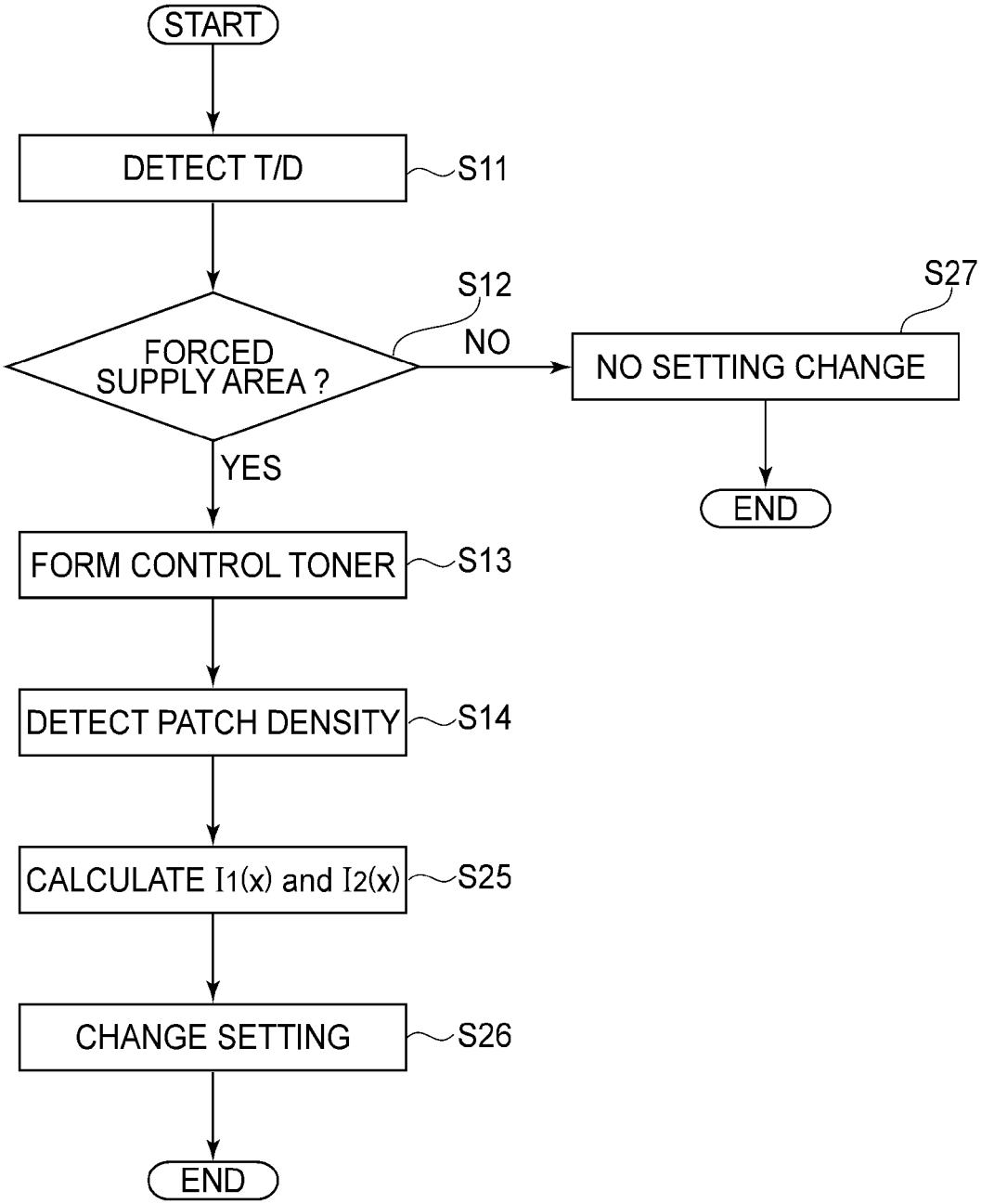
FIG. 16 is a flow chart of the control in Embodiment 2.

FIG. 12 is an explanatory view of a relationship between the transfer current and the transfer efficiency. FIG. 13 is an explanatory view of a relationship between the toner image charge amount and the transfer current value providing the maximum transfer efficiency at the primary transfer portion and FIG. 14 is an explanatory view of a relationship between the toner image charge amount and the transfer current value providing the maximum transfer efficiency at the secondary transfer portion. FIG. 15 is an explanatory view of an effect of control in Embodiment 2 and FIG. 16 is a flow chart of the control in Embodiment 2.

In Embodiment 1, by using the pretransfer charging device 25*a*, the charge amount Q/M of the toner image conveyed to the primary transfer portion T1*a* is adjusted to be adapted to the constant current value of 25 μA of the transfer current at the primary transfer portion T1*a*. On the other hand, in Embodiment 2, a constant current setting value of the transfer current at the primary transfer portion T1*a* is adjusted so as to be adapted to the charge amount Q/M of the toner image conveyed to the primary transfer portion T1*a*.

As shown in FIG. 12 with reference to FIG. 2, when the charge amount Q/M is lowered, a curve of the transfer efficiency is shifted to a lower transfer current side, so that an optimum transfer current setting value is shifted to the low transfer current side. On the other hand, when the charge amount Q/M is increased, the transfer efficiency curve is shifted to the high transfer current side, so that the optimum transfer current setting value is shifted to the high transfer current side. This tendency is similarly shown in the case of the secondary transfer for transferring the toner image onto the recording material P.

Therefore, when the voltage-current condition for the transfer means (the primary transfer portion T1*a* and the secondary transfer portion T2) can be corrected correspondingly to the change in charge amount Q/M, stabilization of the transfer efficiency can be expected even when the toner image charge amount Q/M is changed.

In this embodiment, in the case where the toner content is judged as being in the correction control limit area (A and C in FIG. 5) from the detection result of the inductance sensor 235*a*, a setting value of the constant transfer current at each of the primary transfer portion T1*a* and the secondary transfer portion T2 is corrected.

In this embodiment, as a default setting, a primary transfer current setting value I1 of 25 μA and a secondary transfer current setting value I2 of 45 μA are stored in the storing device 102 in advance. Further, a value of the charge amount Q/M of the two component developer in the fresh state is stored as Q/M (initial) of −25 μC/g in the storing device 102 in advance.

As shown in FIG. 12, the optimum transfer current value varies depending on the toner image charge amount Q/M. In a transfer process, it is necessary to supply a current corresponding to the charge amount of the toner image, so that a necessary transfer current value varies depending on the toner image charge amount Q/M.

As shown in FIG. 13, a relationship between the charge amount Q/M and a transfer current value providing a maximum transfer efficiency shows linearity, so that a change rate of the charge amount Q/M and a change rate of the transfer current value are equal to each other. Therefore, from the change rate of the toner image charge amount Q/M, an optimum transfer current value can be set. In the correction control limit area (A and C in FIG. 5, even when the toner image charge amount Q/A is not −25 μC/g, the optimum primary transfer current setting value for the toner image charge amount Q/M is settable.

As shown in FIG. 14, also at the secondary transfer portion T2, similarly as in the case of the primary transfer portion T1*a*, the change rates of the charge amount Q/M and the transfer current value are equal to each other, so that the optimum transfer current value is settable from the change rate of the charge amount Q/M. In FIG. 14, a white circle represents the transfer current value for a single color toner image and a black dot represents the transfer current value for a secondary color toner image consisting of superposed single color toner images.

As shown in FIG. 2, the control portion 110 measures the change in patch density in the correction control limit area to estimate the change rate of the charge amount Q/M and calculates the optimum transfer current value from the estimated change rate to set the calculated optimum transfer current value for each of the primary transfer portion T1*a* and the secondary transfer portion T2.

Based on the above-described formula (4): $\Delta Q/M(x)=A\times(-\Delta D(x))$, the change amount $\Delta Q/M(x)$ of the charge amount Q/M is calculated from the differential value $\Delta D(x)$ between the sensor output signal at the time of measuring the density of the control toner image formed with the two component developer in the fresh state and the sensor output signal at the time of outputting the x sheets.

The change rate of the charge amount Q/M is obtained from the change amount $\Delta Q/M(x)$ and the charge amount Q/M (initial) according to the following formula (7):

$$(Q/M \text{ change rate})=(Q/M(\text{initial})+\Delta Q/M(x))/(Q/M(\text{initial})) \quad (7)$$

Based on the formulas (4) and (7), at the time of outputting the x sheets, the primary transfer current setting value I1 and the secondary transfer current setting value I2 are obtained according to the following formulas (8) and (9), respectively:

$$I1(x)=(Q/M(\text{initial})-A\Delta D(x))/(Q/M(\text{initial})\times I1 \quad (8)$$

$$I2(x)=(Q/M(\text{initial})-A\Delta D(x))/(Q/M(\text{initial})\times I2 \quad (9)$$

I1(*x*) and I2(*x*) obtained from the formulas (8) and (9) are held in the computing memory 103 and, during subsequent image formation, the control portion 110 sets I1(*x*) in the transfer high voltage circuit 33*a* and sets I2(*x*) in the transfer high voltage circuit 41.

A result of an experiment in which control for changing the transfer current setting value, in the case where the toner content (T/D ratio) is in the correction control limit area (C in FIG. 5) in which the toner content is 5% or less, by using the relationships of the formulas (8) and (9) is shown in FIGS. 15(*a*) to 15(*d*). The measuring method and the like in FIGS. 15(*a*) to 15(*d*) are the same as those in FIGS. 6(*a*) to 6(*d*) described above. Incidentally, although illustration is omitted, with respect to the case where the toner content (T/D ratio) is in the correction control limit area (A in FIG. 5), the control for changing the transfer current setting value is similarly effected by using the relationships of the formulas (8) and (9).

As shown in FIG. 15(*d*), in the change in reflection density of the final image, a solid line represents the case where the transfer current value is not changed and a broken line represents the case where the transfer current value is changed to the transfer current setting value obtained by using the formulas (8) and (9). By the control for changing the transfer current setting value in this embodiment, the lowering in reflection density of the output image occurring when the charge amount Q/M is lowered does not occur, so that a good density change can be retained.

As shown in FIG. 16 with reference to FIG. 2, the control portion 110 obtains the toner content (T/D ratio) from the output of the inductance sensor 235*a* (S11).

When the toner content (T/D ratio) is in the normal supply operation area of 5% to 12% (NO of S12), the control portion 110 does not change the primary transfer current setting value I1(*x*) and the secondary transfer current setting value I2(*x*) (S27). However, when the toner content (T/D ratio) is in the correction control limit area of 5% or less or 12% or less (YES of S12), the control toner image for estimating the charge amount Q/M thereof is formed with the predetermined toner image forming condition (developing contrast) (S13). Then, the control toner image is detected by the patch detection sensor 24*a* to measure the patch density (S14).

The control portion 110 obtains a control amount of the transfer condition (transfer current value), for properly transferring the control toner image with the charge amount Q/M changed from the normal value, from the measurement result of the patch density. The control portion 110 calculates, by using the patch density measurement result, the primary transfer current setting value I1(*x*) and the secondary transfer current setting value I2(*x*) based on the formulas (8) and (9) (S25). Then, the calculated values I1(*x*) and I2(*x*) are set for the primary transfer portion T1*a* and the secondary transfer portion T2, respectively (S26). As a result, in the case where the charge amount Q/M of the control toner image is changed from the normal value, it is possible to set a proper transfer condition without directly measuring the control toner image charge amount Q/M. That is, a proper bias is set through the constant current value in the constant current control.

According to the control in Embodiment 2, in the correction control limit area in which the toner supply control limitation is made, the current-voltage conditions for the primary transfer portion and the secondary transfer portion are controlled on the basis of the detection result of the patch detection ATR control. As a result, the transfer current is ensured corresponding to the lowering in charge amount Q/M of the toner image, so that the image density and the image quality are stabilized.

EMBODIMENT 3

FIG. 12 is an explanatory view of an effect of control in Embodiment 3.

In Embodiment 1 and Embodiment 2, the toner image charge amount Q/M(x) in the correction control limit area at the time of outputting the x sheets is corrected at one time to the toner image charge amount Q/M (initial) in the case of using the two component developer in the fresh state. That is, the amount of the lowering in density of the control toner image is cancelled at one time simultaneously with finding thereof.

On the other hand, in Embodiment 3, the toner image charge amount Q/M(x) in the correction control limit area at the time of outputting the x sheets is corrected gradually toward the toner image charge amount Q/M (initial) in the case of using the two component developer in the fresh state. In the case where a current density lowering amount of the control toner image is larger than a previous density lowering amount of the control toner image, without using such a large control amount that 100% of the control toner image density lowering amount is cancelled at one time, a small control amount such that the control toner image density lowering amount is gradually cancelled in several steps.

In Embodiment 1 and Embodiment 2, in the case where the patch density (sensor output signal) is abruptly changed, the transfer current value for the pretransfer charging device 25*a* or the setting values for the primary transfer portion T1*a* and the secondary transfer portion T2 are abruptly changed. For this reason, there is a possibility that the stability of the density control is broken when the setting value is abruptly changed.

Therefore, in this embodiment, the change value ΔIpost(x) of the set current value for the pretransfer charging device 25*a* changeable at one time is limited. As described above, the change value ΔIpost(x) of the set current value necessary to cancel the patch density change is calculated according to the formula (6) when the patch density is changed and therefore the sensor output signal is changed by ΔD(x). Incidentally, (A/B) is, as described above, a change amount of the set current value required for changing the sensor output signal by one level.

$$\Delta I\text{post}(x)=(A/B)\times(-\Delta D(x)) \quad (6)$$

Specifically, in the case where the differential value ΔD(x) of the sensor output signal corresponding to the control toner image density lowering amount is a threshold Z or more, a patch density (a change amount ΔD(once)) for cancelling the patch density change by a change value ΔIpost(once) at one time, which is defined by formula (11) shown below, is defined by the following formula (10):

$$\Delta D(\text{once})=Z(\text{or } \Delta D(\text{once})=-Z) \quad (10)$$

$$\Delta I\text{post}(\text{once})=(A/B)\times Z \quad (11)$$

In this embodiment, Z is set at 30 but may be other values. In this case, even when the value of ΔD is changed by 50 at one time, the density corrected at one time is up to Z=30 so that a differential value of 20 which is not reflected in the change value ΔIpost(x) of the set current value for the pretransfer charging device 25*a* is carried into subsequent image formation.

Figure 17:
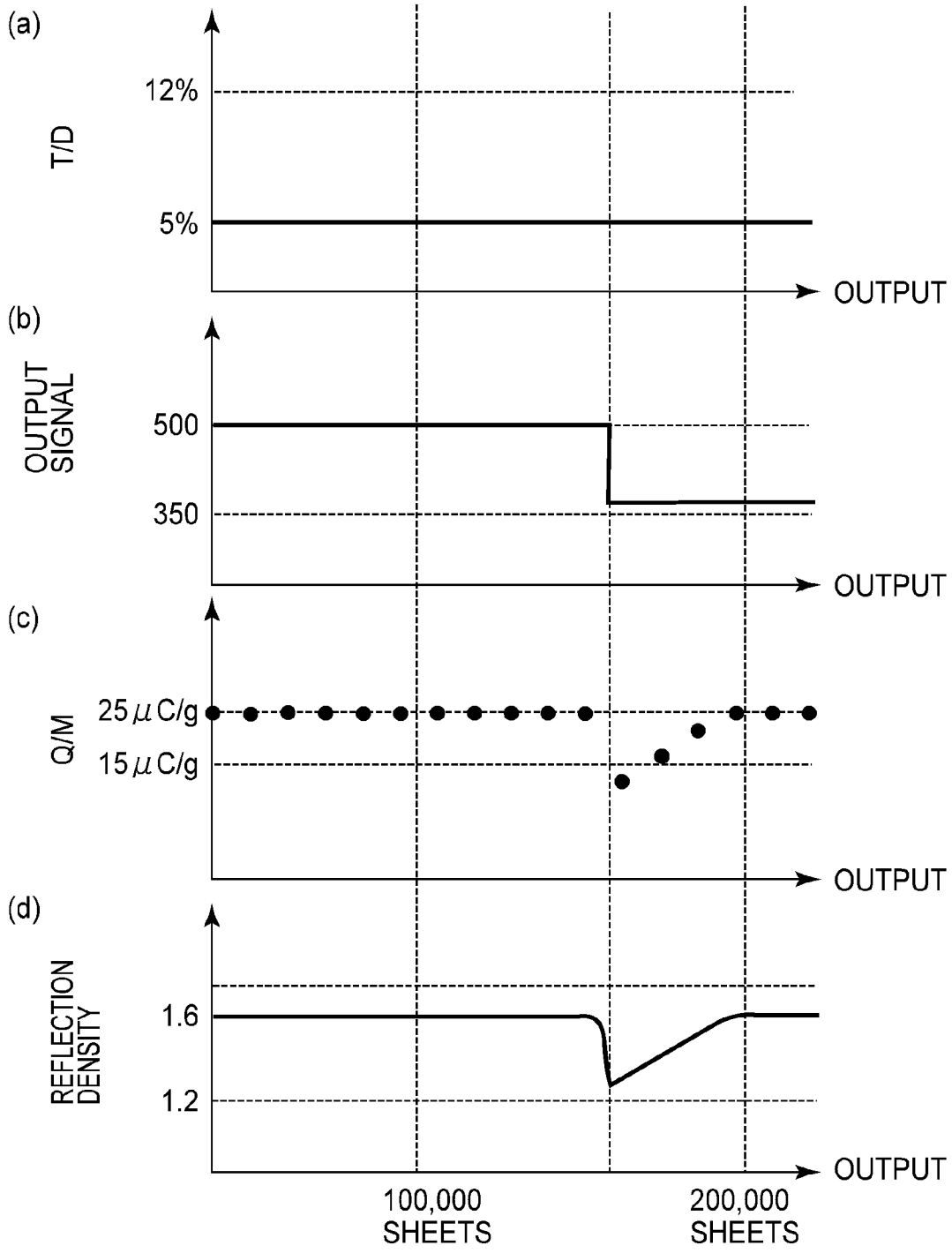
FIG. 17 is an explanatory view of an effect of control in Embodiment 3.

A result of an experiment in which control for actuating the pretransfer charging device 25*a* is effected by using the relationship of the formula (10) in the case where the toner content (T/D ratio) is in the correction control limit area is shown in FIG. 17. The measuring method and the like in FIGS. 17(*a*) to 17(*d*). The measuring method and the like in FIGS. 10(*a*) to 10(*d*) are the same as those in FIGS. 6(*a*) to 6(*d*) described above.

In a state in which the toner content (T/D ratio) is controlled at the lower limit as 5% as shown in FIG. 17(*a*), the patch density of the control toner image formed under the predetermined toner image forming condition is abruptly changed to lower the sensor output signal as shown in FIG. 17(*b*).

In this case, by the control in this embodiment for limiting the density correction amount for one time by using the correction amount of the formula (10), the pretransfer charging device 25*a* is actuated, so that the lower charge amount Q/M of the toner image is gradually corrected to the initial value.

As shown in FIG. 17(*d*), by the control in this embodiment for limiting the density correction amount for one time, the reflection density is gently restored.

According to the control in Embodiment 3, when the pretransfer charging device, the primary transfer portion, and the secondary transfer portion are controlled on the basis of the result of the patch detection ATR control, it is possible to stabilize the image density even when the detection result of the patch detection ATR control is abruptly changed.

As described above, in the image forming apparatus of the present invention, when the toner ratio reaches the predetermined lower limit, in order to obviate the occurrence of the above-described problems due to the lowering in toner ratio, the toner supply means is controlled so as to prevent a further lowering in toner ratio. As a result, as described above, the toner image charge amount is not proper with respect to the transfer condition at the transfer portions and therefore at least one of the transfer condition and the toner image charge amount is changed, so that the relationship between the transfer condition and the toner image charge amount is optimized.

That is, even after the toner ratio in the two component developer reaches the lower limit, the relationship between the toner image charge amount and the transfer condition at the transfer portions is kept at an appropriate level, so that the lowering in transfer efficiency is suppressed and therefore the toner image can be properly transferred onto the transfer medium.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 229547/2008 filed Sep. 8, 2008, which is hereby incorporated by reference.

What is claimed is:

1. An image forming apparatus comprising:

a rotatable image bearing member;

a developing device for forming a developing portion at which an electrostatic latent image formed on said image bearing member is developed with toner;

a toner supply device for supplying toner to said developing device;

a density detecting portion for detecting a density of a control toner image formed on said image bearing member;

a toner ratio detecting portion for detecting a toner ratio in a two component developer contained in said developing device;

a transfer member for forming a transfer portion at which the toner image formed on said image bearing member is transferred onto a transfer medium;

a charging member, disposed downstream of said developing portion and upstream of said transfer portion with respect to a rotational direction of said image bearing member, for electrically charging the toner image formed by said developing device by being supplied with a bias of an identical polarity to a charge polarity of the toner;

an adjusting portion for adjusting an amount of the toner supplied from said toner supply device so that the toner ratio is not below a preset lower limit when the toner ratio detected by said toner ratio detecting portion reaches the lower limit; and a bias determining portion for determining, after the adjustment by said adjusting device, a condition of a bias to be applied to said charging member on the basis of a detection result of said density detecting portion with respect to the density of the control toner image formed on said image bearing member.

2. An apparatus according to claim 1, wherein said adjusting portion controls said toner supply device so as to keep the transfer at the lower limit and controls the bias to be applied to said charging member depending on an amount of a change in density of the control toner image detected by said density detecting portion.

3. An apparatus according to claim 1, wherein when the density detected by said density detecting portion is higher, said bias determining portion makes an absolute value of the bias larger.

4. An apparatus according to claim 1, wherein said density detecting portion is disposed downstream of the developing portion and upstream of said charging member with respect to the rotational direction of said image bearing member.

5. An apparatus according to claim 1, wherein said adjusting portion adjusts an amount of the toner supplied from said toner supply device, not on the basis of a detection result of said density detecting portion with respect to the density of the control toner image formed on said image bearing member, but when the toner ratio detected by said toner ratio detecting portion reaches the lower limit.

6. An image forming apparatus comprising:

a rotatable image bearing member;

a developing device for forming a developing portion at which an electrostatic latent image formed on said image bearing member is developed with toner;

a toner supply device for supplying toner to said developing device;

a density detecting portion for detecting a density of a control toner image formed on said image bearing member;

a toner ratio detecting portion for detecting a toner ratio in a two component developer contained in said developing device;

a transfer member for forming a transfer portion at which the toner image formed on said image bearing member is transferred onto a transfer medium;

an adjusting portion for adjusting an amount of the toner supplied from said toner supply device so that the toner ratio is not below a preset lower limit when the toner ratio detected by said toner ratio detecting portion reaches the lower limit; and a bias controlling portion for controlling, after the adjustment by said adjusting portion, a condition of a bias to be applied to said transfer member on the basis of a detection result of said density detecting portion with respect to the density of the control toner image formed on said image bearing member.

7. An apparatus according to claim 6, wherein said adjusting portion controls said toner supply device so as to keep the transfer at the lower limit and controls the bias to be applied to said transfer member depending on an amount of a change in density of the control toner image detected by said density detecting portion.

8. An apparatus according to claim 6, wherein when the density detected by said density detecting portion is higher, said bias determining portion determines the condition of the bias so that an absolute of a current passing through said transfer member.

9. An apparatus according to claim 6, wherein said density detecting portion is disposed downstream of the developing portion and upstream of said transfer member with respect to the rotational direction of said image bearing member.

10. An apparatus according to claim 6, wherein said adjusting portion adjusts an amount of the toner supplied from said toner supply device, not on the basis of a detection result of said density detecting portion with respect to the density of the control toner image formed on said image bearing member, but when the toner ratio detected by said toner ratio detecting portion reaches the lower limit.

11. An image forming apparatus comprising:

a rotatable image bearing member;

a developing device for developing at a developing portion a latent image formed on said image bearing member with a two component developer including toner and a carrier;

a transfer member for transferring at a transfer portion a toner image formed by development by said developing device onto a transfer medium;

a toner ratio detecting device for detecting a toner ratio in the two component developer contained in said developing device;

an adjusting toner image detecting device for detecting an adjusting toner image formed on said image bearing member by said developing device;

a toner supply device for supplying toner to said developing device;

a toner supply device controlling portion for controlling a toner supply amount from said toner supply device depending on a detection result of said adjusting toner image detecting device when the toner ratio detected by said toner ratio detecting device is more than a lower limit and for switching control of the toner supply amount from said toner supply device so that the toner ratio is not below the lower limit when the toner ratio detected by said toner ratio detecting device reaches the lower limit; and a charging member, disposed downstream of said developing portion and upstream of said transfer portion with respect to a rotational direction of said image bearing member, for electrically charging the toner image formed on said image bearing member by said developing device when the toner supply amount from said toner supply device is controlled by said toner supply device controlling portion so that the toner ratio is not below the lower limit.

12. An apparatus according to claim 11, further comprising a charging member controlling portion for controlling said charging member.

13. An apparatus according to claim 12, wherein said charging member controlling portion controls, on the basis of the detection result of said adjusting toner image detecting device, a condition of a voltage applied to said charging device when the toner ratio detected by said toner ratio detecting device reaches the lower limit.

14. An apparatus according to claim 11, wherein when the toner ratio detected by said toner ratio detecting device is more than the lower limit, said charging member does not charge the toner image formed by said developing device on said image bearing member.

15. An apparatus according to claim 11, further comprising a transfer voltage controlling portion for controlling a condition of a voltage applied to said transfer member so that the voltage applied to said transfer member when the toner ratio detected by said toner ratio detecting device is more than the lower limit is the same as that when the toner ratio detected by said toner ratio detecting device reaches the lower limit.

16. An apparatus according to claim 11, wherein said adjusting toner image detecting device is disposed downstream of said developing portion and upstream of said transfer member with respect to a rotational direction of said image bearing member.

17. An image forming apparatus comprising:

a rotatable image bearing member;

a developing device for developing at a developing portion a latent image formed on said image bearing member with a two component developer including toner and a carrier;

a transfer member for transferring at a transfer portion a toner image formed by development by said developing device onto a transfer medium;

a toner ratio detecting device for detecting a toner ratio in the two component developer contained in said developing device;

an adjusting toner image detecting device for detecting an adjusting toner image formed on said image bearing member by said developing device;

a toner supply device for supplying toner to said developing device;

a toner supply device controlling portion for controlling a toner supply amount from said toner supply device depending on a detection result of said adjusting toner image detecting device when the toner ratio detected by said toner ratio detecting device is more than a lower limit and for controlling the toner supply amount from said toner supply device so that the toner ratio is not below the lower limit when the toner ratio detected by said toner ratio detecting device reaches the lower limit; and a transfer voltage controlling portion for controlling, on the basis of the detection result of said adjusting toner image detecting device, a voltage applied to said transfer member so that the voltage applied to said transfer member is controlled when the toner ratio detected by said toner ratio detecting device reaches the lower limit.

18. An apparatus according to claim 17, wherein said transfer voltage controlling portion controls the voltage applied to said transfer member so that the voltage applied to said transfer member when the toner ratio detected by said toner ratio detecting device reaches the lower limit is larger than that when the toner ratio detected by said toner ratio detecting device is more than the lower limit.

19. An apparatus according to claim 17, wherein said adjusting toner image detecting device is disposed downstream of said developing portion and upstream of said transfer member with respect to a rotational direction of said image bearing member.

* * * * *